US012516872B2

(12) United States Patent
Simioni et al.

(10) Patent No.: US 12,516,872 B2
(45) Date of Patent: Jan. 6, 2026

(54) REFRIGERATION APPLIANCE WITH FLEXIBLE DRAWER CAPACITY

(71) Applicant: ELECTROLUX APPLIANCES AKTIEBOLAG, Stockholm (SE)

(72) Inventors: Matteo Simioni, Santa Lucia di Piave (IT); Andrea Malausa, Santa Lucia di Piave (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 153 days.

(21) Appl. No.: 18/270,262

(22) PCT Filed: Jan. 27, 2021

(86) PCT No.: PCT/EP2021/051874

§ 371 (c)(1),
(2) Date: Jun. 29, 2023

(87) PCT Pub. No.: WO2022/161603

PCT Pub. Date: Aug. 4, 2022

(65) Prior Publication Data

US 2024/0060711 A1 Feb. 22, 2024

(51) Int. Cl.
*F25D 25/02* (2006.01)
*F25D 23/06* (2006.01)
(Continued)

(52) U.S. Cl.
CPC ..... *F25D 25/025* (2013.01); *F25D 23/067* (2013.01); *A47B 88/402* (2017.01);
(Continued)

(58) Field of Classification Search
CPC .... F25D 25/025; F25D 17/042; F25D 17/045; F25D 25/021; F25D 25/02; F25D 23/067;
(Continued)

(56) References Cited

U.S. PATENT DOCUMENTS 10,045,829 B1 8/2018 Norman et al.
10,378,814 B1 8/2019 Gaye
(Continued)

FOREIGN PATENT DOCUMENTS

CN 1156237 8/1997
CN 104949466 A * 9/2015
(Continued)

OTHER PUBLICATIONS

International Search Report for PCT/EP2021/051874, dated Oct. 20, 2021, 2 pages.

*Primary Examiner* — Kimberley S Wright
(74) *Attorney, Agent, or Firm* — Chrisman Gallo Tochrop LLC

(57) ABSTRACT

The invention relates to a refrigeration appliance, in particular a refrigerator or a fridge-freezer (2). The refrigeration appliance comprises a housing (4), a refrigerating compartment (6) formed within the housing (4), a slidably and releasably supported first drawer (20*a*) having a first vertical extension, a second slidably and releasably supported second drawer (20*b*) having a second vertical extension being greater than the first vertical extension of the first drawer (20*a*), and a first, a second and a third drawer support position (72*a*, 72*b*, 74*a*, 74*b*, 76*a*, 76*b*), wherein in vertical direction the first drawer support position (72*a*, 72*b*) is higher than the second drawer support position (74*a*, 74*b*) and the second drawer support position (74*a*, 74*b*) is higher than the third drawer support position (76*a*, 76*b*). When A) the first or second drawer (20*a*, 20*b*) is supported at the first drawer support position (72*b*) the upper levels of the first and second drawers (20*a*, 20*b*) are at the same vertical position within the refrigerating compartment (6), and when the first drawer (20*a*) is supported at the third drawer support position (76*b*) or when the second drawer (20*b*) is supported at the second drawer support position (74*b*) the lower levels
(Continued)

Figure 1:
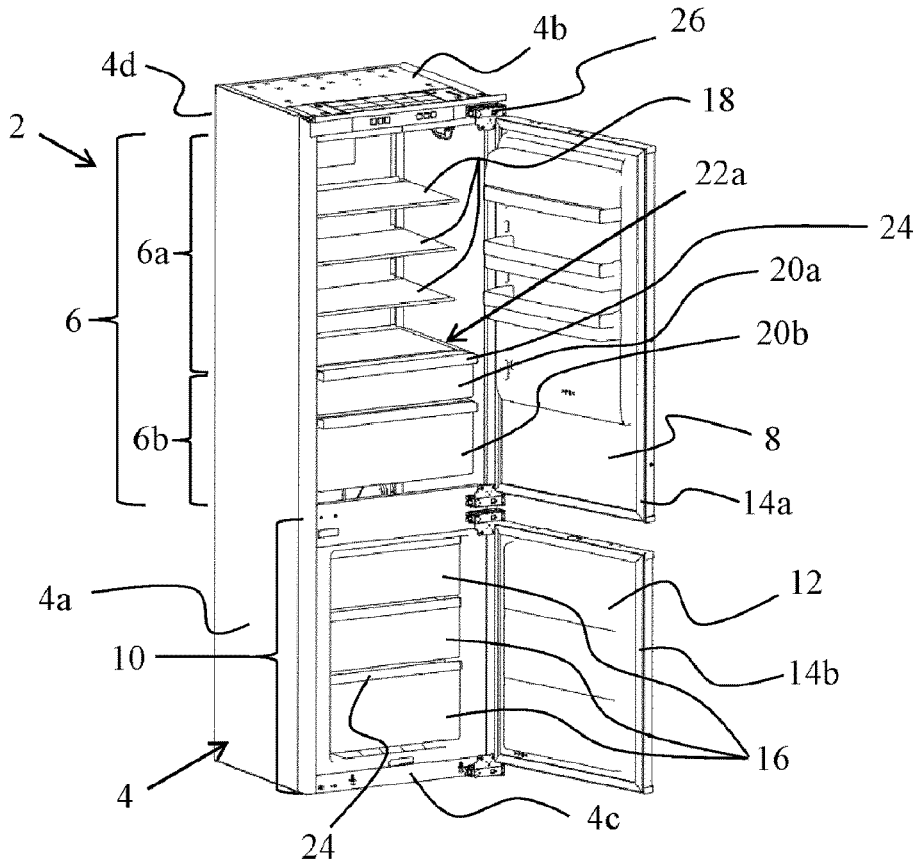

of the first and second drawers (20*a,* 20*b*) are at the same vertical position within the refrigerating compartment (6), or when B) the first or second drawer (20*a,* 20*b*) is supported at the third drawer support position (76*a*) the upper levels of the first and second drawers (20*a,* 20*b*) are at the same vertical position within the refrigerating compartment (6), and when the first drawer (20*a*) is supported at the second drawer support position (74*a*) or when the second drawer (20*b*) is supported at the first drawer support position (72*a*) the lower levels of the first and second drawers (20*a,* 20*b*) are at the same vertical position within the refrigerating compartment (6).

17 Claims, 11 Drawing Sheets

(51) Int. Cl.

| | |
|---|---|
| *A47B 88/40* | (2017.01) |
| *A47B 88/57* | (2017.01) |
| *F25D 17/04* | (2006.01) |
| *F25D 17/06* | (2006.01) |

(52) U.S. Cl.
CPC ..... *A47B 88/57* (2017.01); *A47B 2210/175* (2013.01); *F25D 17/042* (2013.01); *F25D 17/065* (2013.01)

(58) Field of Classification Search
CPC . A47B 88/402; A47B 88/57; A47B 2210/175; A47B 2210/0062
See application file for complete search history.

(56) References Cited

U.S. PATENT DOCUMENTS

| | | | | |
|---|---|---|---|---|
| 2016/0356538 | A1* | 12/2016 | Park | F25D 25/025 |
| 2017/0122651 | A1 | 5/2017 | Cizik et al. | |
| 2019/0032989 | A1* | 1/2019 | Kim | F25B 13/00 |
| 2019/0293342 | A1* | 9/2019 | Butenhoff | F25D 25/025 |
| 2021/0330080 | A1* | 10/2021 | Wang | F25D 25/025 |

FOREIGN PATENT DOCUMENTS

| | | | | |
|---|---|---|---|---|
| CN | 105579796 A | * | 5/2016 | F25D 17/042 |
| DE | 20217327 U1 | * | 5/2003 | A47B 88/16 |
| KR | 200389709 Y1 | * | 7/2005 | |

* cited by examiner

A-A

REFRIGERATION APPLIANCE WITH FLEXIBLE DRAWER CAPACITY

The present invention relates to a refrigeration appliance, in particular to a refrigerator for cooling foodstuffs, or a fridge-freezer for cooling and freezing foodstuffs.

US2017/0122651 A1 suggests a domestic refrigeration appliance with a housing in which a receiving chamber for foodstuffs with an additional compartment is formed, wherein the additional compartment can be reversibly assembled and disassembled in the receiving chamber.

It is an object of the invention to provide a refrigeration appliance and a method with an increased flexibility in the arrangement of the drawers in the refrigerating compartment, in particular with in increased flexibility of storing foodstuff according to its preservation need.

The invention is defined in claims 1 and 15, respectively. Particular embodiments are set out in the dependent claims.

According to claim 1, a refrigeration appliance is provided, in particular a refrigerator or a fridge-freezer. The appliance comprises: a housing, a refrigerating compartment formed within the housing, a slidably and releasably supported first drawer having a first vertical extension, a second slidably and releasably supported second drawer having a second vertical extension being greater than the first vertical extension of the first drawer, and a first, a second and a third drawer support position, wherein in vertical direction the first drawer support position is higher than the second drawer support position and the second drawer support position is higher than the third drawer support position. An option A) for arranging and reconfiguring the drawers and an option B) for arranging and reconfiguring the drawers are provided. When in option A) the first or second drawer is supported at the first drawer support position the upper levels of the first and second drawers are at the same vertical position within the refrigerating compartment, and when the first drawer is supported at the third drawer support position or when the second drawer is supported at the second drawer support position the lower levels of the first and second drawers are at the same vertical position within the refrigerating compartment. When in option B) the first or second drawer is supported at the third drawer support position the upper levels of the first and second drawers are at the same vertical position within the refrigerating compartment, and when the first drawer is supported at the second drawer support position or when the second drawer is supported at the first drawer support position the lower levels of the first and second drawers are at the same vertical position within the refrigerating compartment.

By providing a refrigerating compartment with the first, second and third drawer support position and the first drawer and second drawer having the vertical extension being greater than the first vertical extension of the first drawer, the first and second drawers can be exchanged in their position and thus the volume for storing foods can be adjusted (e.g. the lower or larger volume drawer can be positioned in the vertically upper position) by the user according to her/his needs. This results in a user-selectable position of larger volume drawer.

Further drawers may be arranged above the vertically upper one of the first and second drawers and/or below the vertically positioned lower one of the first and second drawers. Preferably, the vertically positioned lower one of the first and second drawers is arranged immediately above the bottom of the refrigerating compartment without any further storage space between the bottom of the drawer and an inner bottom wall of the refrigerant compartment. Alternatively, the first and second drawers are arranged in an upper position of the refrigerating compartment, preferably at the top or middle of the refrigerating compartment, with further storage space (e.g. for further drawers) above the vertically upper one of the first and second drawers and/or below the bottom of the vertically positioned lower one of the first and second drawers.

Preferred, the second drawer has a volume capacity in the range between 20-23, 22-25, 24-27, or 26-29 liters and/or the first drawer has a volume capacity in the range between 10-13, 12-15, 14-17 or 16-19 liters. The 'volume capacity' may correspond to the inner volume of the drawer, in particular the volume that can be used for storing foodstuffs. The different volume capacities of the first and second drawers are the result of the different vertical extensions of the first and second drawers. Preferably the second drawer with the grater vertical extension has also the larger volume capacity, i.e. in this case the volume capacity of the second drawer is larger than the volume capacity of the first drawer. Preferably the difference in vertical extension and/or volume capacity is at least 15%, 20%, 25%, 30%, 40% or 50%.

Preferably, in option B) the height difference between the first and second drawer support positions corresponds or substantially corresponds to the difference between the first and second vertical extensions of the first and second drawers. In option A) the height difference between the second and third drawer support positions may correspond or may substantially correspond to the difference between the first and second vertical extensions of the first and second drawers.

Preferably, the first drawer has a pair of bearing elements adapted to slidably support the first drawer at a pair of rail elements formed at side walls of the refrigerating compartment, and wherein the second drawer has a pair of bearing elements to slidably support the second drawer at a pair of rail elements formed at side walls of the refrigerating compartment.

A 'rail element' may be e.g. a horizontal protrusion on which the drawer is releasably mountable or it may be a recess formed within the side walls of the refrigerating compartment (e.g. at the inner liner) into which the bearing elements of the drawer can be inserted and releasably mounted.

Preferably, each bearing element of a pair of bearing elements of a drawer corresponds to a lateral protrusion (i.e. horizontal protrusion) pointing away from the drawer (i.e. facing the inner side walls of the refrigerating compartment)

The rail element and/or the bearing element is preferably configured in such a way that the drawer cannot be pulled out completely when the drawer is opened by pulling it out from the front. In particular, the rail element and/or the bearing element of the drawer comprise a stop element which ensures that the drawer does not fall completely out of the compartment when the user is pulling out the drawer.

Preferably, the refrigerating compartment has a plurality of pairs of rail elements provided at opposing lateral sides of the refrigerating compartment, wherein at least three pairs of rail elements are provided at different vertical levels within the refrigerating compartment and wherein a first pair of rail elements is provided at the vertical height of the first drawer support position, a second pair of rail elements is provided at the vertical height of the second drawer support position, and a third pair of rail elements is provided at the vertical height of the third drawer support position.

A pair of intermediate support elements for slidably supporting the drawer may be provided at opposing lateral sides of each of the first and second drawers between the pair of bearing elements of the drawer and a pair of rail elements. The pair of intermediate support elements is mounted at the drawer or at the pair of rail elements.

Preferably, the intermediate support element comprises a slide. The slides may be e.g. telescopic slides or slides with roller guides. Using the intermediate support elements may ensure an improved extraction range for the drawers, and may increase the durability due to less friction when moving the drawer which results in lower wear.

Preferably, each drawer further comprises a cover element mounted at the top of the drawer which is adapted to close the drawer (i.e. adapted to delimit the drawer volume from top). The cover element may be designed as a pivotable cover or as a slidable cover. The slidable cover may either be designed in one piece so that the top of the drawer can be opened and closed by sliding the one part back and forth, or it may be designed as a two-part element so that the top of the drawer can be opened and closed by sliding the two parts against each other.

Preferably the appliance further comprises an upper shelf mounted within the compartment, and a lower shelf mounted within the compartment at a vertical position below the upper shelf, wherein either A) the upper shelf is mounted in the compartment at the first drawer support position and the lower shelf is mounted releasably in the compartment (selectively) at the second or the third drawer support position.

Or in option B) the upper shelf is mounted releasably in the compartment (selectively) at the first or the second drawer support position and the lower shelf is mounted in the compartment at the third drawer support position. Preferably the first drawer is adapted to be slidably supported (selectively) below the upper shelf or below the lower shelf, and the second drawer is adapted to be slidably supported (selectively) below the upper shelf or below the lower shelf, wherein the first drawer fits into the compartment space between the upper and lower shelves when A) the lower shelf is mounted in the second drawer support position, or when B) the upper shelf is mounted in the second drawer support position, and wherein the second drawer fits into the compartment space between the upper and lower shelves when A) the lower shelf is mounted in the third drawer support position, or when B) the upper shelf is mounted in the first drawer support position.

The vertical positions of the upper shelf may correspond to the vertical positions of the upper level of the vertically positioned upper one of the first and second drawers, and the vertical positions of the lower shelf may correspond to the vertical positions of the upper level of the vertically positioned lower one of the first and second drawers.

Preferably in A) the second and third drawer support position of the lower shelf are below the position of the upper shelf (e.g. below the first drawer support position), and in B) the first and second drawer support position of the upper shelf are above the position of lower shelf (e.g. above the third drawer support position).

Even in option A) the upper shelf may be releasable and optionally may be positioned at different vertical drawer support positions within the compartment (above the lower shelf). Even in option B) the lower shelf may be releasable and optionally may be positioned at different vertical drawer support positions within the compartment (below the lower shelf).

The 'compartment space' is a (specific) volume region within the refrigerating compartment having a vertical extension and being defined between the upper and lower shelves, in particular it is the volume enclosed by the upper shelf and lower shelf and the side walls and the rear wall of the refrigerating compartment.

'Fits into compartment space' means that size tolerance/play is provided for the drawers such that the drawer can be moved, in particular can be pulled out and pushed in, in the compartment space. There is no further (foodstuff) storage space between the upper end of the drawer arranged in the compartment space, in particular the vertically positioned upper one of the first and second drawers, and the lower side of the upper shelf, and no further storage space between the bottom wall of the drawer and topside of the lower shelf.

Each drawer may comprise a handle for enabling access to the chamber arranged at the front of the drawer, respectively.

The first and second drawers are exchangeable, wherein the arrangement of the first and second drawer and the upper and lower shelf occupy the same vertical height within the refrigerant compartment independent whether the first or the second drawer is the vertically positioned upper one of the first and second drawers (i.e. if the first drawer is arranged above the second drawer or vice versa). In particular, the vertical distance between the upper shelf and the bottom side of the vertically positioned lower one of the first and second drawers is always the same, independent whether the first or the second drawer is the vertically positioned upper one of the first and second drawers.

Further drawers may be arranged above the upper shelf and/or below the vertically positioned lower one of the first and second drawers. Preferably, the vertically positioned lower one of the first and second drawers is arranged immediately above the bottom of the refrigerating compartment without any further storage space between the bottom of the drawer and an inner bottom wall of the refrigerant compartment. Alternatively, the lower and upper shelves and the first and second drawers are arranged in an upper position of the refrigerating compartment, preferably at the top or middle of the refrigerating compartment, with further storage space (e.g. for further shelves and/or drawers) above the upper shelf and/or between the bottom of the vertically positioned lower one of the first and second drawers and the inner bottom wall of the refrigerant compartment.

When exchanging the first and second drawers only the position of one of the two shelves has to be changed and not the position of both shelves. Preferably, when exchanging the drawers, the upper shelf remains in its position (e.g. first drawer support position) and the lower shelf is mounted at the second or third drawer support position. Alternatively, the lower shelf remains in its position (third drawer support position) and the upper shelf is mounted at the first or second drawer support position.

By using a drawer, the handling is simplified, in particular the loading and unloading of foodstuffs into the drawers. By changing the position of the first and/or second shelf, the first and second drawer having different vertical extensions can be exchanged in their position and thus the volume for storing foods can be adjusted (e.g. the lower or larger volume drawer can be positioned in the vertically upper position) by the user according to her/his needs. This results in a user-selectable position of the larger volume drawer.

In a retracted position of the drawer, the top of the respective drawer (i.e. the inner volume of the drawer) may be closed by the shelf. Alternatively (e.g. if no shelves are provided) or additionally, each drawer may comprise a separate cover element which is mounted at the top of the drawer for opening and closing of the top of the drawer.

Preferably, the 'shelf' has the function of slidably supporting the first and/or second drawer below the shelf and of being mountable at an inner wall of the refrigerating compartment. The shelf may comprise horizontal protrusions provided on opposing sides walls of the shelf which are mountable on a pair of rail elements formed in the refrigerating compartment. Additionally or alternatively, the shelf comprises a continuous recess from front to back of the shelf which can be inserted in a pair of rail elements formed in the refrigerating compartment.

Preferably, the upper and/or lower shelf comprises a pair of vertical side walls mounted at opposite side surfaces of the shelf for supporting slides. Each side wall may be arranged vertically on each side surface of the shelf (i.e. on the surface which is parallel to the side walls of the appliance) when seen the appliance from a front view. Both side walls may further comprise mounting elements at an outer surface (i.e. surface facing the inner side wall of the refrigerating compartment) for mounting the shelf to the inner surface of the refrigerant compartment. Preferably each side wall comprises a slide fixed horizontally and parallel to the side walls of the refrigerating compartment for detachably and slidably mounting of the drawer to the shelf. Each vertical side wall may comprise a horizontal protrusion facing each other on which the slide may be mountable. The slides may be e.g. telescopic slides or slides with roller guides. The side wall is preferably a continuous wall, e.g. extending along the whole side surface of the shelf, but may also be e.g. a wall with several window-shaped passages separated by ribs.

Preferably, the shelf and the pair of side walls are manufactured in a single piece construction. The shelf may be made of plastic, preferably manufactured by injection molding. Alternatively, the shelf and the side walls can be formed as separate elements, e.g. by injection molding, that are assembled afterwards, e.g. by gluing or welding. Preferably, the shelf, in particular the upper shelf, is made of a transparent material such as transparent plastic or glass. In view of the upper shelf and the vertically positioned upper one of the first and second drawers, the consumer can thus at least partially see the foods stored in the vertically positioned upper one of the first and second drawers without the need to open it.

The drawers are preferably made of plastic, in particular manufactured by injection molding. More preferably, the drawers are made of transparent plastic. The drawers and/or the cover element (and/or the upper and/or lower shelf in case of using shelves) may comprise insulated material to prevent temperature variations and undesirable heating of the food in the drawers. This improves the food shelf life of the foodstuffs stored within the drawers.

Preferably, in operation of the refrigeration appliance i) a first preservation condition is provided in an upper volume section, which is the volume section within the vertically positioned upper one of the first and second drawers and/or between the upper level of the vertically positioned upper one of the first and second drawers and the upper level of the vertically positioned lower one of the first and second drawers; and/or ii) a second preservation condition is provided in a lower volume section, which is the volume section within the vertically positioned lower one of the first and second drawers and/or below the upper level of the vertically positioned lower one of the first and second drawers; and wherein the first and second preservation conditions are different to each other.

In particular, in case of the embodiment with shelves, the upper volume section may be the volume section within the compartment between the upper shelf and the lower shelf, and the lower volume section may be the volume section within the compartment in the compartment space below the lower shelf.

A further object of the invention is to provide a refrigeration appliance with an increased flexibility in the arrangement of drawers with regard to different preservation conditions. This problem is solved by providing the first preservation condition in the upper volume section (i.e. around and/or within the vertically positioned upper one of the first and second drawers) and the second preservation condition in the lower volume section (i.e. around and/or within the vertically positioned lower one of the first and second drawers). By changing the drawers, the first (second) drawer previously supplied with the first preservation condition is then provided with the second preservation condition, and the second (first) drawer is then provided with the first preservation condition.

Due to the user-selectable position of the drawers, the user (consumer) can modify the drawer capacity (due to the different vertical extensions of the drawers) for the first and second preservation condition considering different needs in terms of quantity of different food typologies to be stored e.g. meat and fish or fruits and vegetables.

In operation of the appliance the storing space within the refrigerating compartment which may be provided for food to be stored in the refrigerating compartment above and/or below the first and second drawers may be different from the preservation conditions provided for the first and second preservations conditions.

Preferably, the first and/or second preservation condition comprises one or more of the following (a) the air temperature, (b) the air humidity, and (c) absorbing components of the air affecting the preservation of foodstuffs by using an absorbing material. The alternatives (a), (b), and/or (c) are the following and are disclosed herein. The first and/or second preservation condition may comprise (a), or (b), or (c), or (a) and (b), or (a) and (c), or (b) and (c), or (a) and (b) and (c). In this or an analog way all and/or conjunctions mean this single or multiple combinations.

Preferably the first preservation condition in the upper volume section comprises the air humidity (i.e. regulating the humidity) within the vertically positioned upper one of the first and second drawers and the second preservation condition in the lower volume section comprises the air temperature within the vertically positioned lower one of the first and second drawers; in particular, the first drawer is a crisper (i.e. a maintenance of the humidity inside the drawer is obtained; if e.g. new vegetables are put in the drawer, a new high humidity value is maintained in the drawer, in particular by using a membrane as described further below) and the second drawer is a chiller (low-temperature).

The temperature within the upper volume section may be in the range of 2-4, 3-5 or 4-6° C. and/or the temperature within the lower volume section may be in the range of −3 to −1, −2 to 1, −1 to 2, 0 to 3 or 1 to 4° C. A temperature sensor may be arranged within the first and/or second drawer, at the cover element or in case of using shelves at the shelf for measuring the air temperature within the drawer.

Preferably, in operation of the appliance the air humidity within the first and/or second drawer is established by at least one membrane mounted (arranged) at the top of the first and/or second drawer. In particular, the membrane may be mounted (arranged) at a cover element provided at the top of the drawer, or in case of using a shelf, the membrane may be mounted (arranged) at the upper and/or lower shelf. In case of using shelves, the air humidity may remain unchanged in the upper and lower volume section when exchanging the first and second drawers.

The membrane may be designed in such a way that a higher humidity value is established inside the drawer by reducing the air exchange between the air inside the drawer and the remaining air in the refrigerant compartment. Preferably, the higher value of humidity is achieved by integrating a membrane at the top of the drawer.

The membrane is preferably arranged near or at the front wall of the drawer (i.e. at the front of the cover element or the shelf when seen the appliance from a front view). More preferably, the membrane extends along the whole or substantially the whole width of the cover element or the shelf when seen the appliance in a front view.

Alternatively, the humidity loss rate within the drawer can be varied with an input element, e.g. a slider or a button for (user-) adjusting the degree of an opening that provides an air-communication between the interior and exterior of the drawer), between a low and a high level of the humidity loss rate. Varying the humidity loss rate results in different values of humidity within the first and/or second drawers.

In particular, the humidity loss rate may be varied by adjusting the gap between the drawer and the cover element or the shelf (when using shelves in the appliance). A big gap corresponds to a high humidity loss rate as the air circulation through the drawer is increased. A small gap corresponds to a lower humidity loss rate as the air circulation through the drawer is decreased.

In addition to the low and high humidity level, the input may further comprise several intermediate levels between the low and high level representing different humidity loss rates. Preferably, the input has symbols for each humidity loss rate, wherein each symbol represents at least one foodstuff which indicates that this is the appropriate humidity loss rate for the foodstuff. A humidity sensor may be arranged within the first and/or second drawer, e.g. at a side wall or rear wall of the drawer or may be arranged at the cover element or at the shelf for measuring the humidity value within the drawer.

Preferably, the absorbing material is adapted to absorb odors and/or ethylene, in particular the absorbing material is a solid material such as e.g. oxygen and/or carbon dioxide absorbers. It may also be possible to use absorber materials that absorb any other gases affecting the preservation of foodstuff.

Preferably, the absorbing material is arranged within the first and/or second drawer, in particular at a cover element or at the upper and/or lower shelf, and/or at an inner wall of the refrigerating compartment surrounding the lower volume section and/or the upper volume section. Preferably, the absorbing material may be arranged at the inner rear wall of the refrigerating compartment, in particular at the rear wall of the lower volume section and/or the upper volume section.

The material may be positioned outside of the drawer, if the air entering the refrigerating compartment is fed directly into the drawer and thus components of the air flowing into the drawer, which affect the preservation of foodstuffs, can be absorbed before entering the drawer. Preferably, the absorbing material is positioned close to an air inlet at the inner rear wall of the refrigerating compartment for introducing cold air into the refrigerant compartment, but it may also be arranged at a position without any air circulation. If no air is fed directly into the drawer, the absorbing material is preferably positioned within the first and/or second drawer, in particular at a side or rear wall of the drawer, at the cover element of the drawer or in case of using shelves at the upper and/or lower shelf. If the absorbing material is arranged within the drawer or at the cover element mounted at the drawer, the absorbing material is also exchanged between the two drawers when exchanging the first and second drawers.

By setting specific temperatures, humidity values and/or absorption of odors and/or ethylene, in particular by absorbing gases such as e.g. $CO_2$ or oxygen, the preservation of foodstuff stored in the upper and/or lower volume section, in particular in the first and/or second drawer, may be improved. The first drawer (e.g. crisper) may be used for preserving e.g. fruits and/or vegetables and/or the second drawer (e.g. low-temperature chamber/chiller) may be used for preserving e.g. meat and/or fish.

Preferably, the appliance comprises a control unit for controlling the temperatures and/or the humidity value within the drawers; the control unit may receive signals from temperature and/or humidity sensors arranged in or at the drawer and may adjust the temperature or humidity within the drawers by varying the fan speed and thus the amount of cold air fed into the lower volume section of the refrigerating compartment. Alternatively or additionally, in case of a fridge-freezer, the air temperature and/or humidity value may be adjusted by setting a flap position between the air supplies of the freezer compartment and the refrigerating compartment such that cold air is guided from the freezer compartment to the lower volume section of the refrigerating compartment.

Preferably, in operation of the appliance, the difference in preservation conditions between the upper and lower volume section is established by cold air flowing towards the first and/or second drawer, and/or towards the compartment space below the upper level of the vertically positioned lower one of the first and second drawers and/or the compartment space below the upper level of the vertically positioned upper one of the first and second drawers.

The appliance may further comprise an air guide arrangement for introducing cold air into the refrigerating compartment comprising at least one air inlet arranged below the upper level of the vertically positioned lower one of the first and second drawers such that the air flows from below the upper level of the vertically positioned lower one of the first and second drawers to the top of the refrigerating compartment.

The air introduced into the refrigerating compartment through the air inlet is flowing from bottom to top of the refrigerating compartment wherein the cold air warms up more and more. This creates different temperature zones that cause, among others things, the first and second preservation conditions in the upper and lower volume section (i.e. within the first and/or second drawer).

The air guide arrangement may further comprise at least one fan for circulating the air, an air duct with an evaporator for cooling the air and/or a refrigerating system comprising the evaporator, a compressor, a condenser and an expansion device. Preferably, the warmed air is sucked off by at least one fan through an air outlet arranged at the rear wall of the refrigerating compartment (e.g. at the top or near the top of the rear wall). The fan is preferably arranged in front of or behind the air outlet.

Preferably, the air sucked off the refrigerating compartment is guided through an air channel arranged between the housing and the refrigerating compartment (e.g. between the rear wall of the housing and the refrigerating compartment) having an evaporator. The evaporator may extend in the air duct at the rear wall of the refrigerating compartment from top to bottom. The condenser may be arranged at the outside of the rear wall of the housing and preferably extends from top to bottom.

When passing the evaporator the warm air is cooled by transferring heat from the warm air to the cold refrigerant flowing through the evaporator. The cold air is re-introduced into the refrigerating compartment through the air inlet in the lower volume section (e.g. below lower shelf). A refrigerant may be circulated between the evaporator, a compressor, a condenser and an expansion device. The refrigerant is evaporated in the evaporator by heat transfer from the warm air flowing past the evaporator. Then the refrigerant is fed to the compressor where it is raised to higher pressures and thereby becomes liquid again. From there the refrigerant is fed to the condenser where the refrigerant is cooled down again. Preferably, cold air from the outside of the appliance is used for cooling the refrigerant in the condenser. From there the refrigerant flows through the expansion device where it is expanded and then the refrigerant flows through the evaporator again. The compressor is preferably arranged at a lower region of the refrigerator appliance, preferably at a rear region at the bottom of the appliance.

Preferably, in operation of the appliance, cold air is introduced into the refrigerating compartment through at least one air inlet arranged at an inner wall of the refrigerating compartment below the upper level of the vertically positioned lower one of the first and second drawers, and wherein the difference in preservation conditions between the upper and lower volume section is established by one of the following: cold air introduced through the air inlet and flowing around the drawers, or cold air introduced through the air inlet and flowing into the vertically positioned lower and/or upper one of the first and second drawers, wherein each drawer comprises at least one recess arranged at a side wall and/or rear wall of the drawer, and wherein the air inlet and the recess of each drawer are configured such that the cold air introduced through the air inlet is guidable through the recess of the vertically positioned lower one of the first and second drawers into the drawer.

In one case the air may be introduced into the refrigerating compartment by the air inlet arranged at an inner side wall of the refrigerating compartment (preferably at the bottom of the rear wall) and the drawers may not comprise any inlets for the air. Thereby, the cold air flows from the lower volume section (e.g. the bottom of the refrigerating compartment) to the top of the refrigerating compartment, wherein the drawers are cooled by the air flowing around them (i.e. no direct air flow into the drawers). As already mentioned above, in this case the absorbing material is preferably positioned in the drawers and not at the outside of the drawers, as no air is directly guided into the drawers. Due to the fact that cold air is supplied in the lower volume section, the lowest temperature is at the very bottom and the temperature rises accordingly towards the top.

Alternatively, the air may be fed through the air inlet into the refrigerant compartment and from there through a recess of the drawer directly into the vertically positioned lower drawer of the first and second drawers. After inserting the vertically positioned lower drawer of the first and second drawers, the drawer and the air inlet may be e.g. so close that the air can flow through the air inlet in form of a free air flow directly into the drawer, or alternatively, the air inlet may be provided with an elastic seal (e.g. gasket) forming an air channel between the air inlet and the recess of the drawer after insertion of the drawer.

The alignment of the recess of the vertically positioned lower drawer of the first and second drawers with the air inlet prevents the blocking of the air inlet and ensures an air supply no matter if the first or second drawer is arranged in the lower vertical position. Preferably, the air exits the vertically positioned lower drawer of the first and second drawers through a gap between the closed cover element arranged at the top of the drawer and the drawer or in case of using shelves in the appliance through a gap between the shelf and the drawer. More preferably, the drawers comprise slits or other small openings with a different shape arranged within the drawers, in particular at a side wall or a front wall of each drawer through which the air can exit each drawer.

Preferably the appliance comprises one air inlet arranged below the vertically positioned lower one of the first and second drawers at an inner rear wall of the refrigerating compartment and the first and second drawer each comprises one recess arranged at the rear wall of the drawer, wherein each of the recesses of the first and second drawers is alignable with the air inlet arranged at the rear wall of the refrigerating compartment independent of which is the vertically positioned lower one of the first and second drawers. Thereby, the inside of the vertically positioned lower drawer of the first and second drawers is fed with cold air through the recess, wherein the vertically positioned upper drawer of the first and second drawers is cooled by the air flowing around the drawer.

In case of a fridge-freezer, in addition or as an alternative, cold air from the freezer compartment may be supplied to the region below the lower drawer of the first and second drawers (e.g. to the lower volume section) through a connection duct, which is preferably arranged at the bottom or rear wall of the refrigerating compartment. In another alternative, the upper and lower volume sections each have their own control systems with its own temperature sensor for measuring the temperature of the air in each section, respectively. And/or the refrigerator appliance may comprise different evaporators, wherein the lower volume section (section below the lower drawer of the first and second drawers) may have its own evaporator. Each of the upper and lower volume section may have its own air inflow into each drawer having a recess positioned in the respective volume section.

In such an arrangement, the cold air may be supplied independently to the lower and/or upper volume section of the refrigerating compartment. In particular, by adjusting flaps positioned in the air duct ensuring that the air is directed to the lower volume section and/or the upper volume section. Preferably, the temperature sensors for each drawer are arranged within the drawer or in case of using shelves at the shelf.

In this alternative, it may be possible to control the preservation condition (e.g. temperature and/or humidity) of the upper and lower volume sections independently of each other. In particular, depending on the fan speed, the temperature of the air fed into the lower volume section of the refrigerating compartment may be adjusted. Alternatively or additionally in case of a fridge-freezer, the air temperature may be adjusted by setting a flap position such that cold air of the freezer compartment is guided from the freezer compartment to the lower volume section of the refrigerating compartment.

According to claim 15, a method for exchanging drawers in a refrigeration appliance, in particular in a refrigeration appliance as described above, is provided, wherein the refrigeration appliance comprises: a housing, a refrigerating compartment formed within the housing; a slidably and releasably supported first drawer having a first vertical extension, a second slidably and releasably supported second drawer having a second vertical extension being greater than the first vertical extension of the first drawer; and a first, a second and a third drawer support position, wherein in vertical direction the first drawer support position is higher than the second drawer support position and the second drawer support position is higher than the third drawer support position. The method comprises: A) removing the first or second drawer from the first drawer support position, and removing the second drawer from the second drawer support position or the first drawer from the third drawer support position, or B) removing the first or second drawer from the third drawer support position, and removing the second drawer from the first drawer support position or the first drawer from the second drawer support position; and A) mounting the first drawer at the third drawer support position and the second drawer at the first drawer support position or the first drawer at the first drawer support position and the second drawer at the second drawer support position, or B) mounting the first drawer at the second drawer support position and the second drawer at the third drawer support position or the second drawer at the first drawer support position and the first drawer at the third drawer support position.

In Case of Using Shelves in the Appliance:

If the first drawer is arranged between the upper and lower shelves, and the second drawer below the lower shelf, after changing of the drawers, the second drawer is arranged between the upper and lower shelves, and the first drawer below the lower shelf. If the second drawer is arranged between the upper and lower shelves, and the first drawer below the lower shelf, after changing of the drawers, the first drawer is arranged between the upper and lower shelves, and the second drawer below the lower shelf.

Each individual feature of the refrigeration appliance can be combined with the method, or any sub-group of features (e.g. any of the dependent claims) of the refrigeration appliance can be individually combined with the method. Vice versa any individual feature or sub-group of features of the method can be combined with the refrigeration appliance as a functional feature of the refrigeration appliance.

Any feature disclosed herein (for the above embodiments and/or configurations and from the below described detailed embodiments and modifications) can be combined with the claimed subject individually or in any sub-combination.

Figure 2:
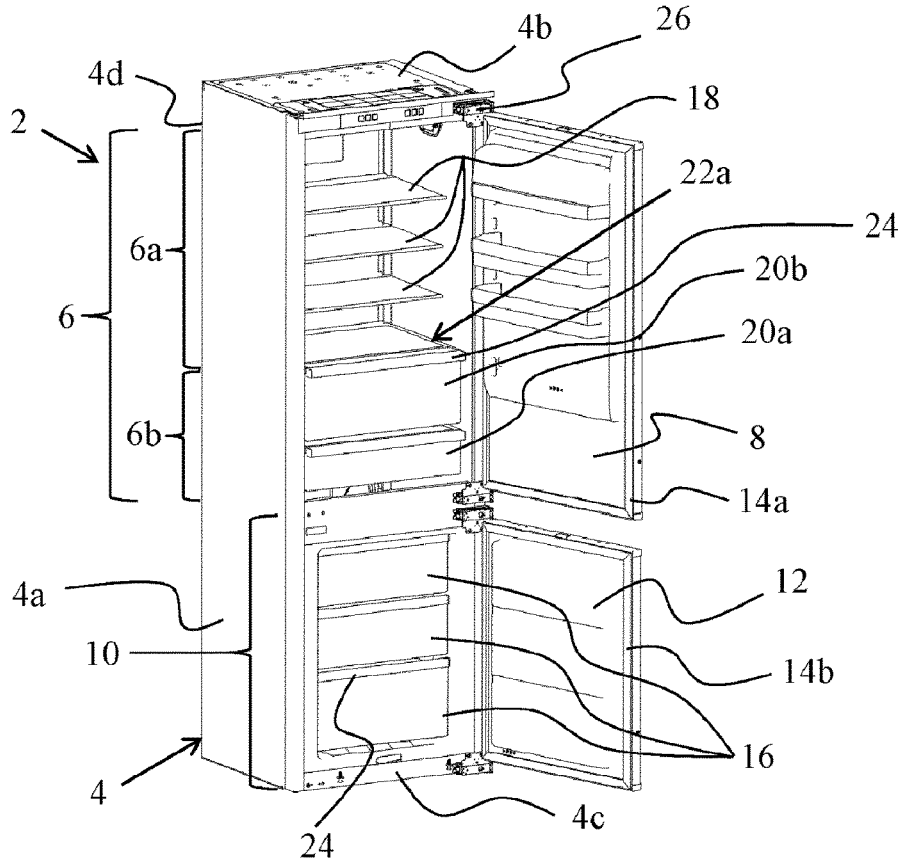
Figure 3A:
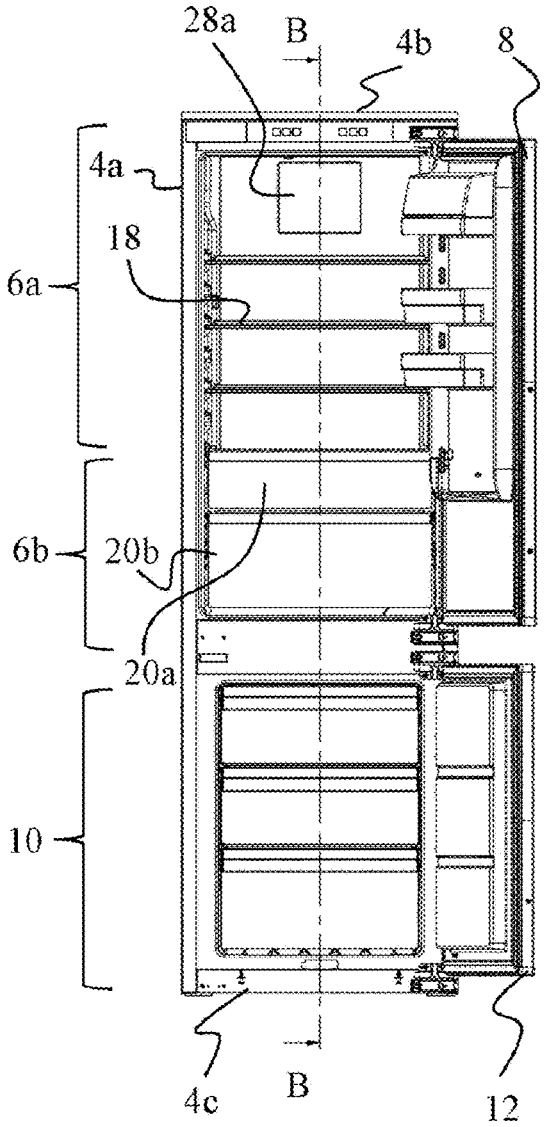
Figure 3B:
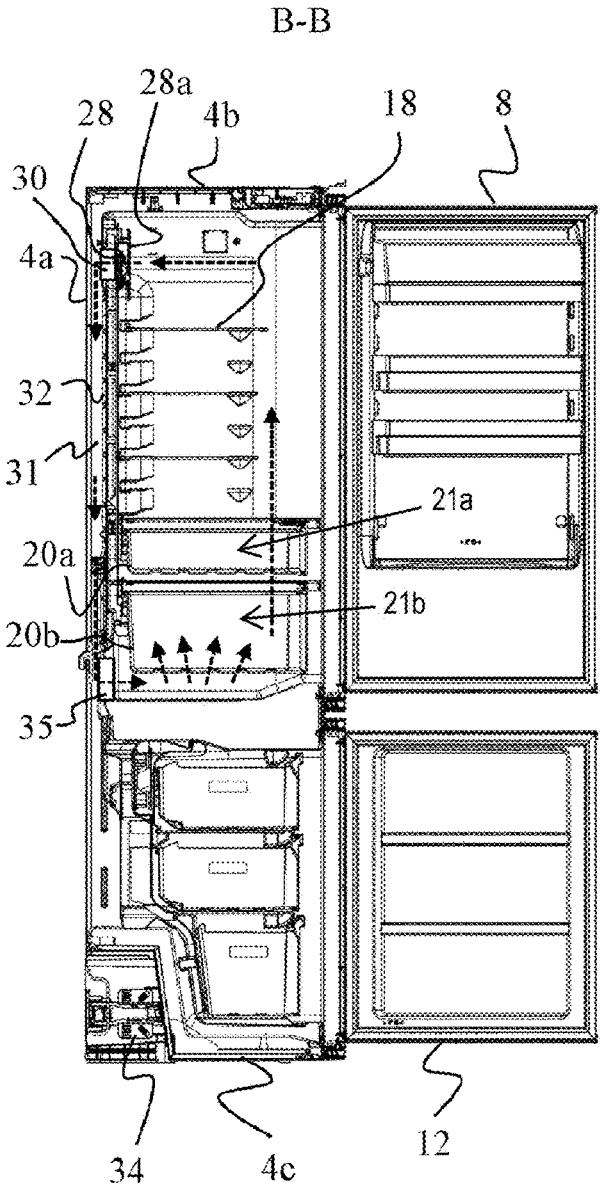
Figure 4B:
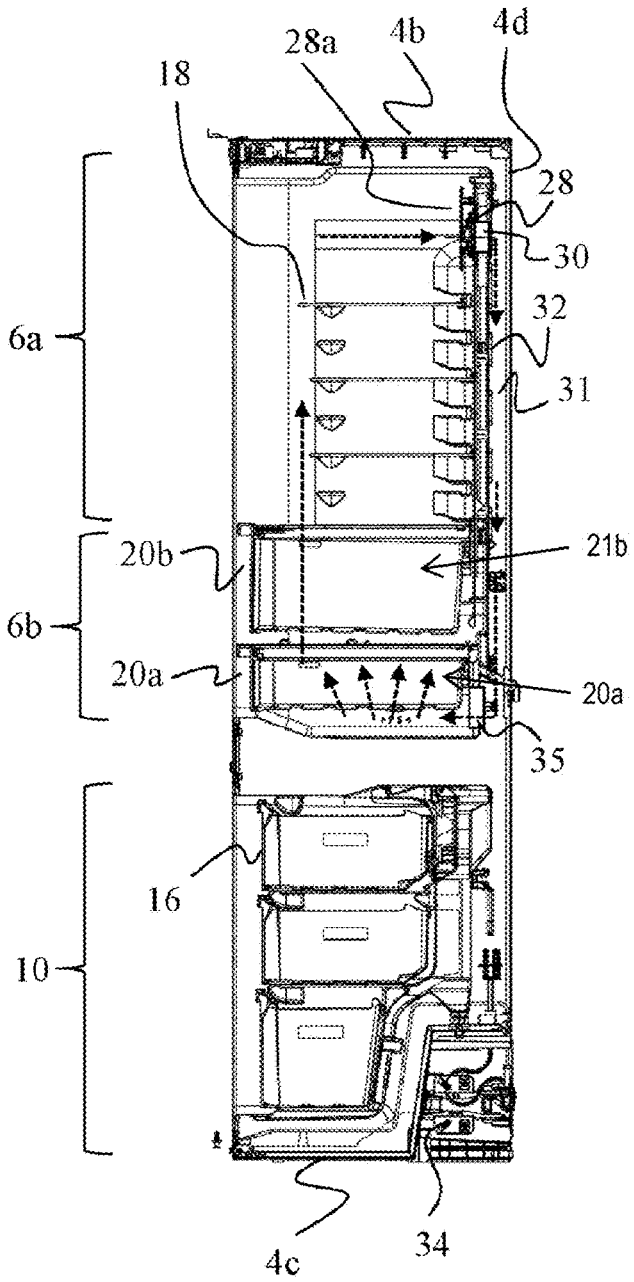
Figure 4A:
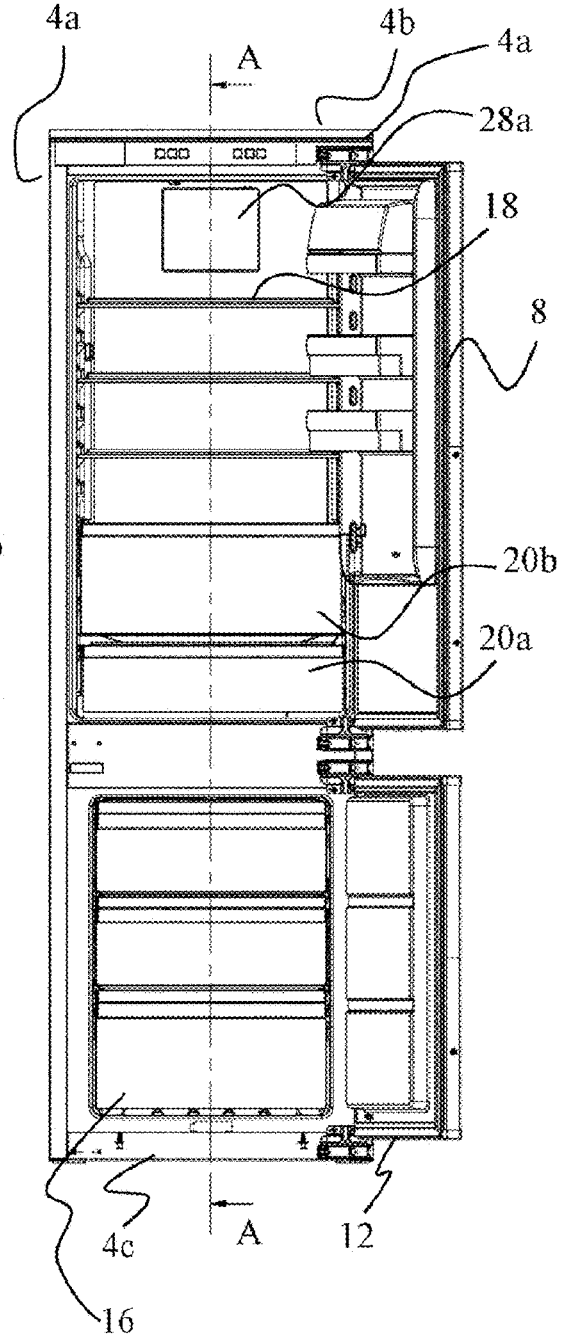
Figure 5:
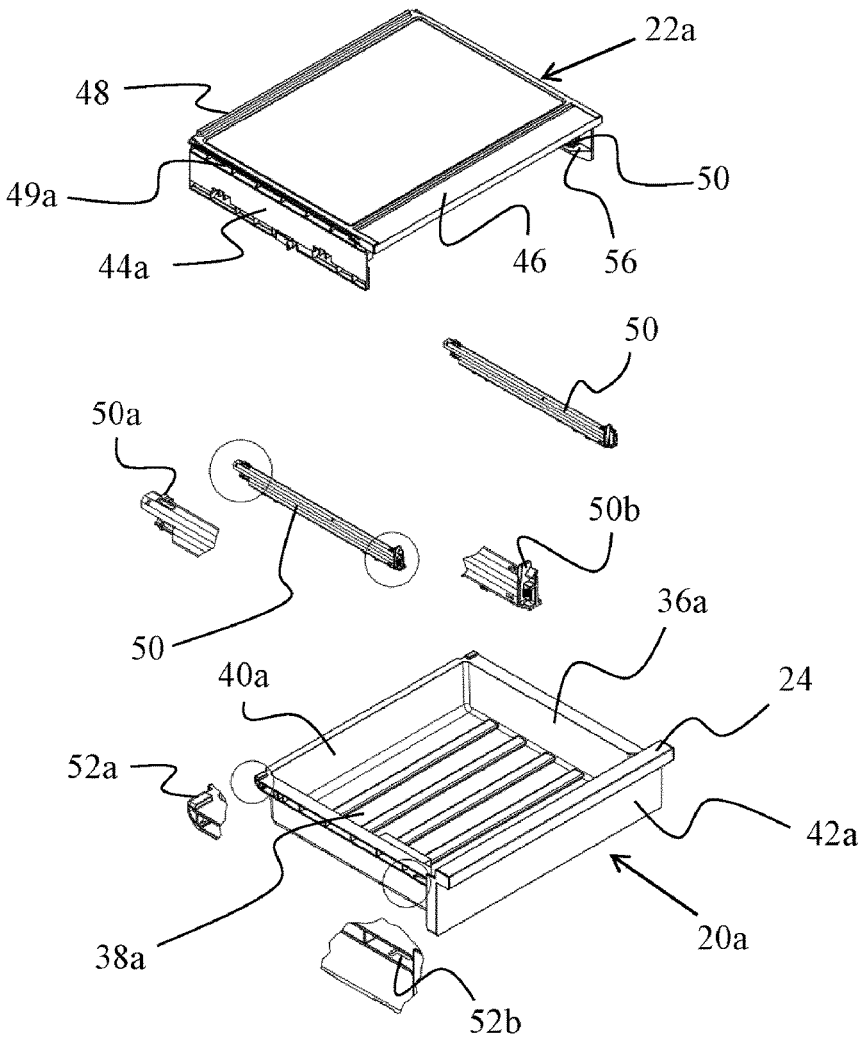
Figure 6:
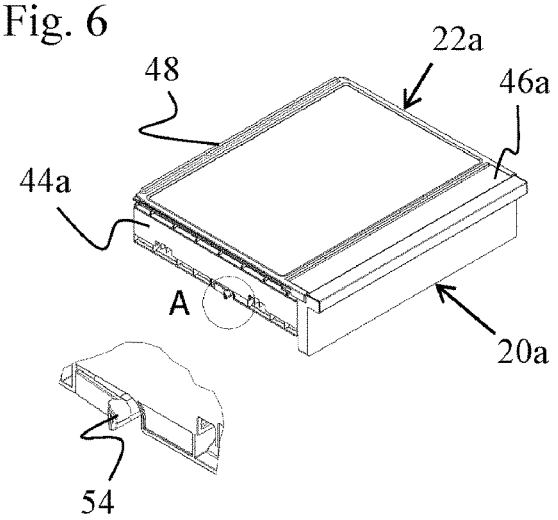
Figure 7:
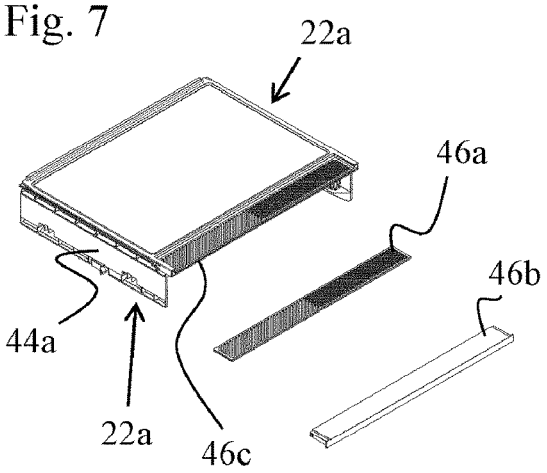
Figure 8:
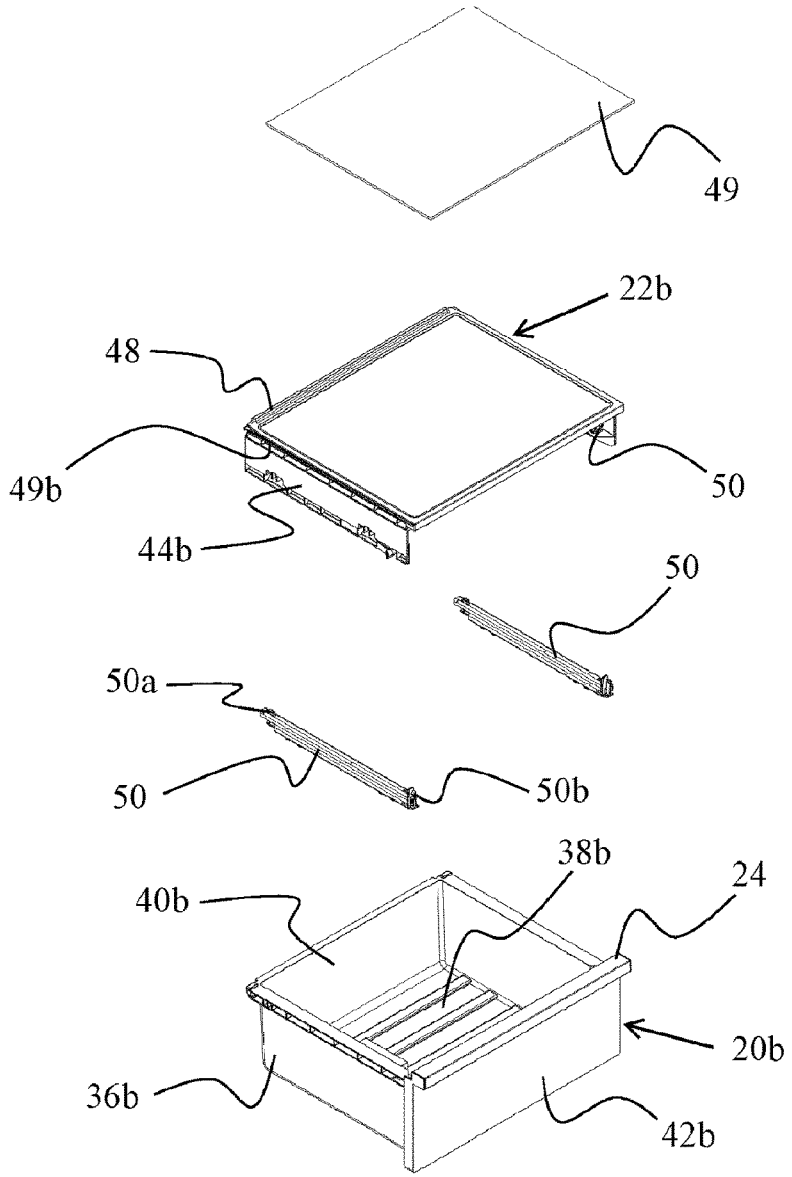
Figure 9:
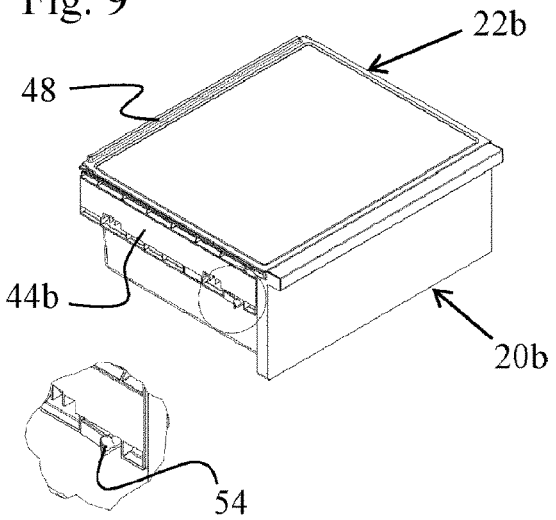
Figure 10:
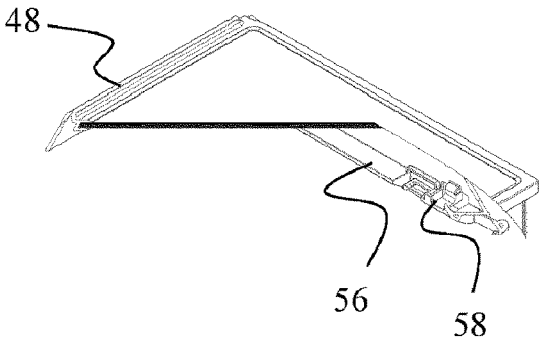
Figure 11A:
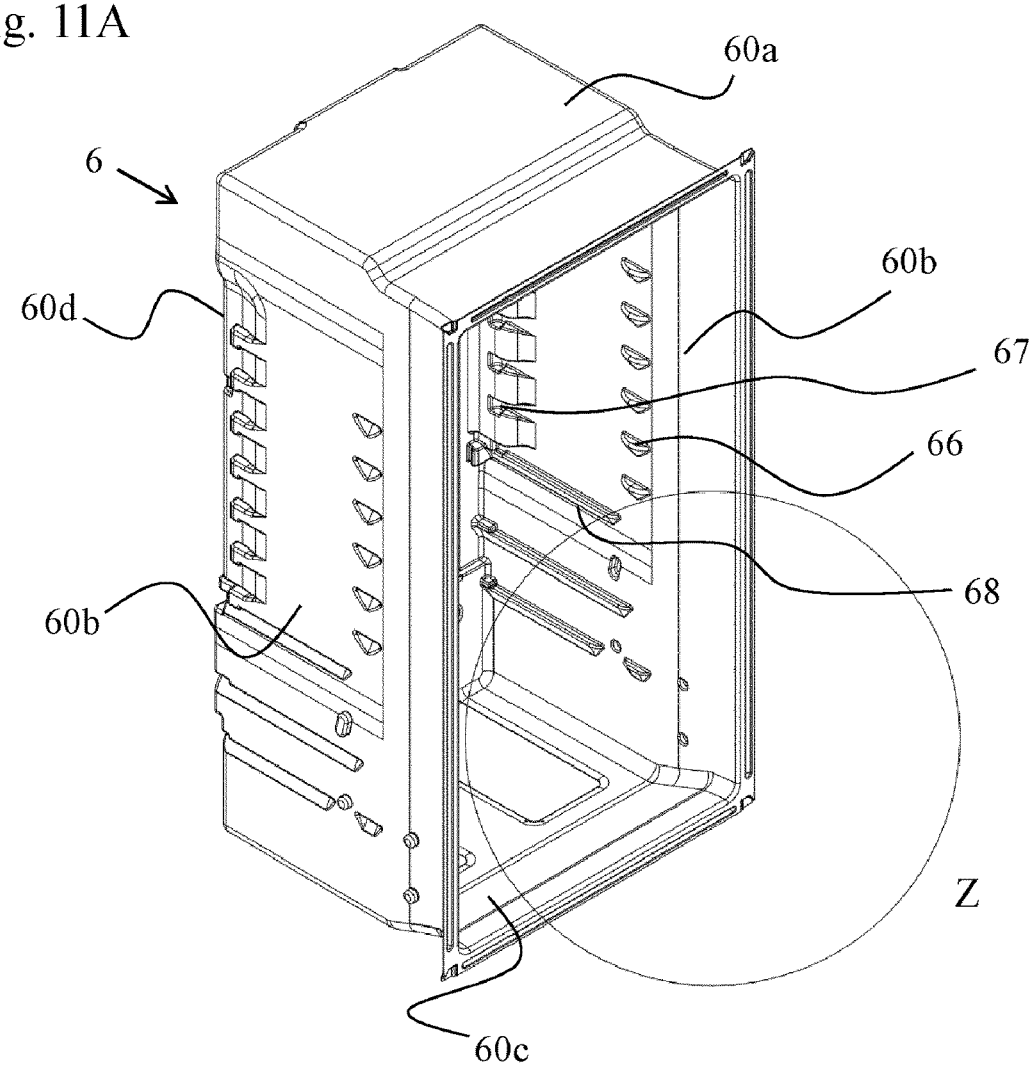
Figure 11B:
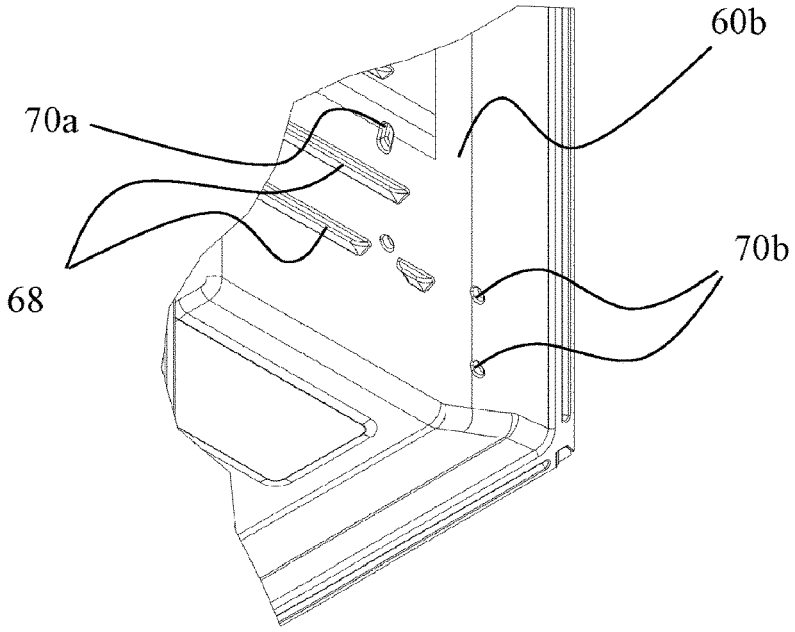
Figure 12:
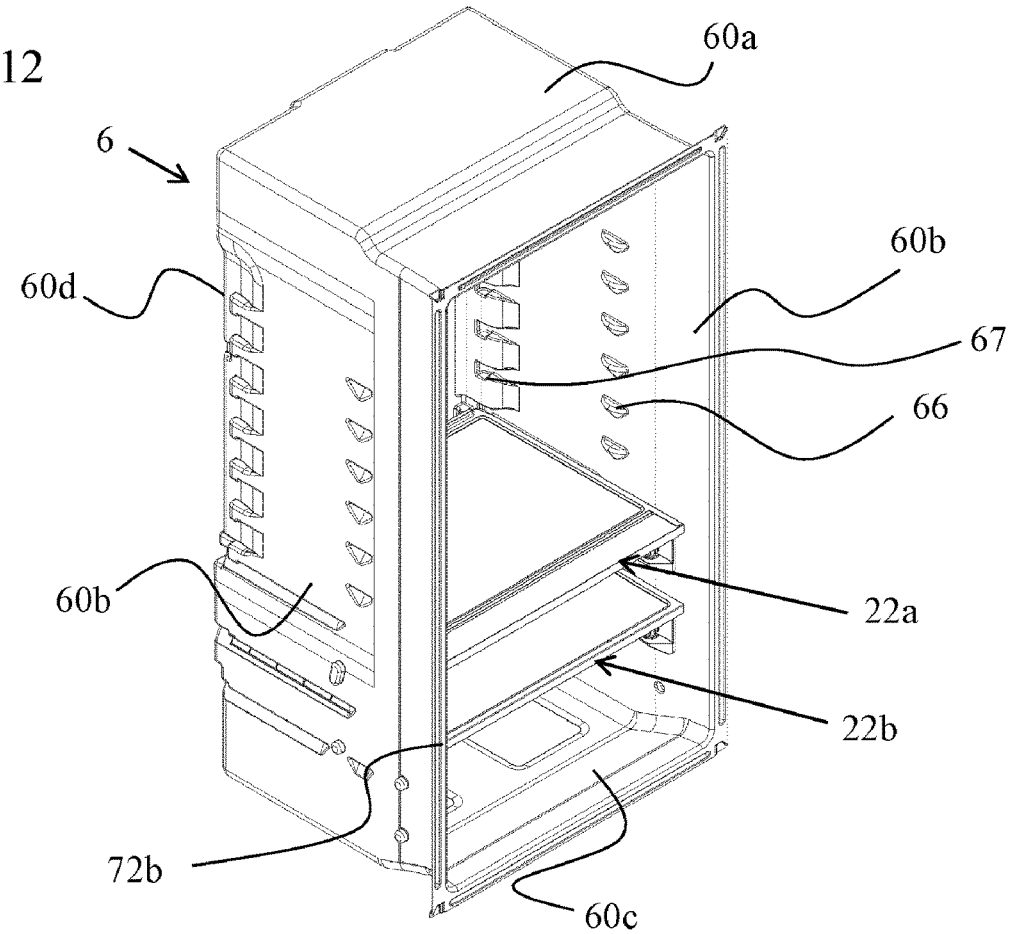
Figure 13:
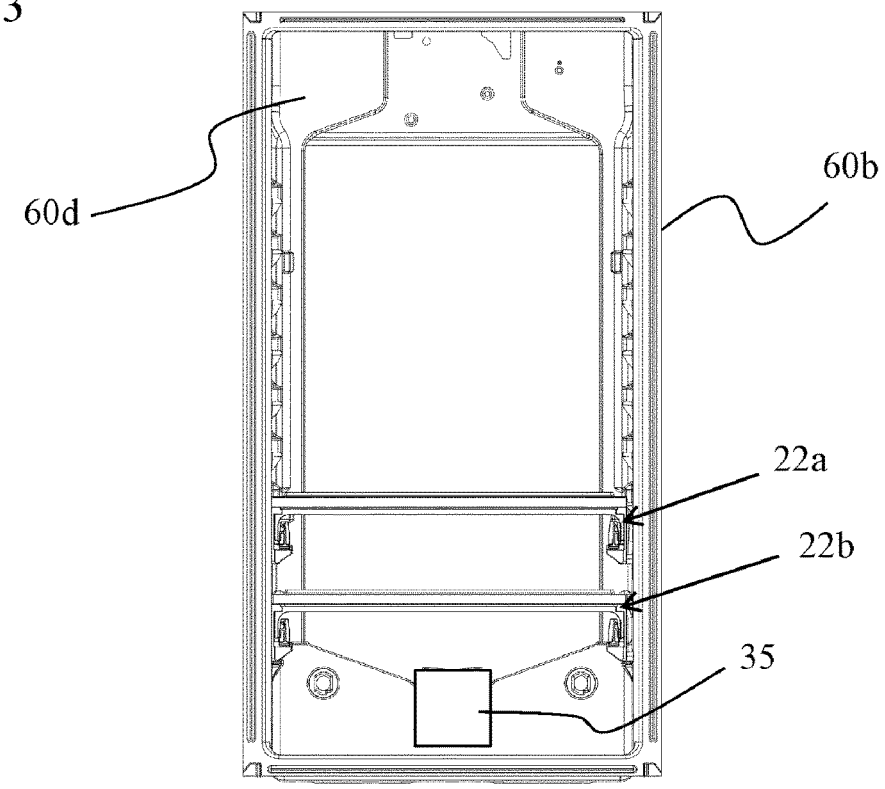
Figure 14:
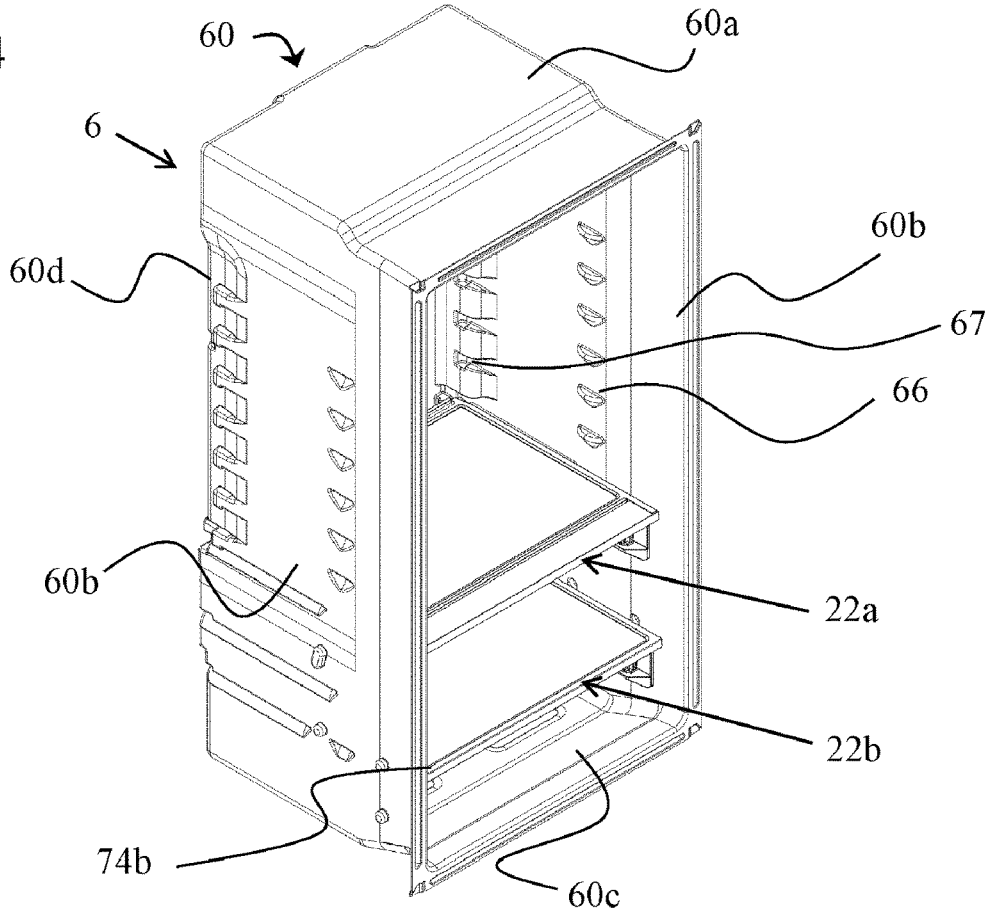
Figure 15:
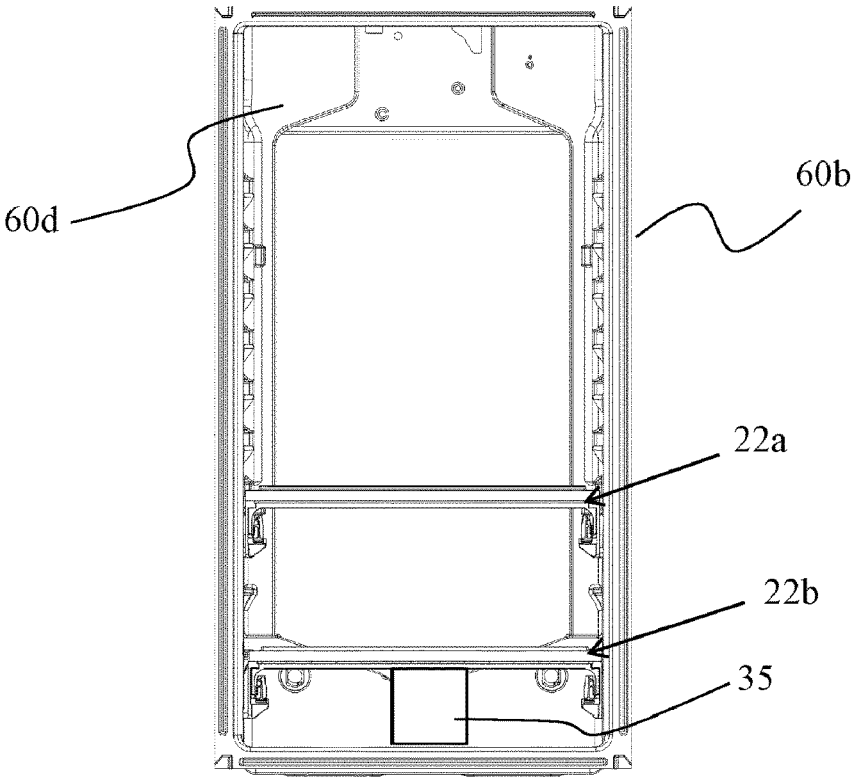

Reference is made in detail to preferred embodiments of the invention, examples of which are illustrated in the accompanying figures, which show:

FIG. 1 a perspective outer appearance of a fridge-freezer with an opened door and a first and a second drawer, FIG. 2 the perspective outer appearance of the fridge-freezer of FIG. 1 with a reversed position of the first and second drawer, FIG. 3A a front view of the fridge-freezer of FIG. 2, FIG. 3B a sectional view of the fridge-freezer according to the intersection line B-B of FIG. 3A, FIG. 4A a front view of the fridge-freezer of FIG. 1, FIG. 4B a sectional view of the fridge-freezer according to the intersection line A-A of FIG. 4A, FIG. 5 an exploded view of the arrangement of the first shelf and the first drawer, FIG. 6 a perspective view of the first shelf and the first drawer in an assembled state FIG. 7 an exploded view of the first shelf, FIG. 8 an exploded view of the arrangement of the second shelf and the second drawer, FIG. 9 a perspective view of the second shelf and the second drawer in an assembled state with a detailed view of the side wall of the second shelf, FIG. 10 a perspective view of the second shelf with a section, FIG. 11A a perspective view of the refrigerating compartment of the fridge-freezer without the shelves and the drawers, FIG. 11B a detailed perspective view of region Z of FIG. 11A, FIG. 12 a perspective view of the refrigerating compartment of FIG. 11A with the first and second shelves, FIG. 13 a front view of the refrigerating compartment of FIG. 12, FIG. 14 a perspective view of the refrigerating compartment of FIG. 12 with another positioning of the first and second shelves, FIG. 15 a front view of the refrigerating compartment of FIG. 14

Figure 16:
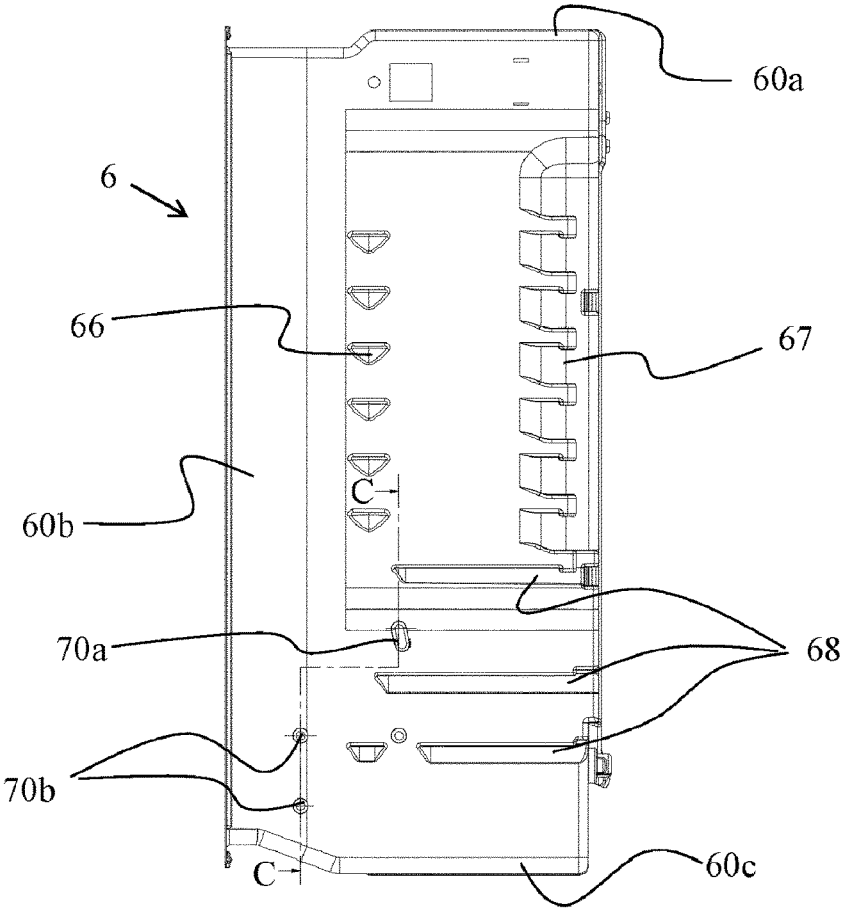
Figure 17:
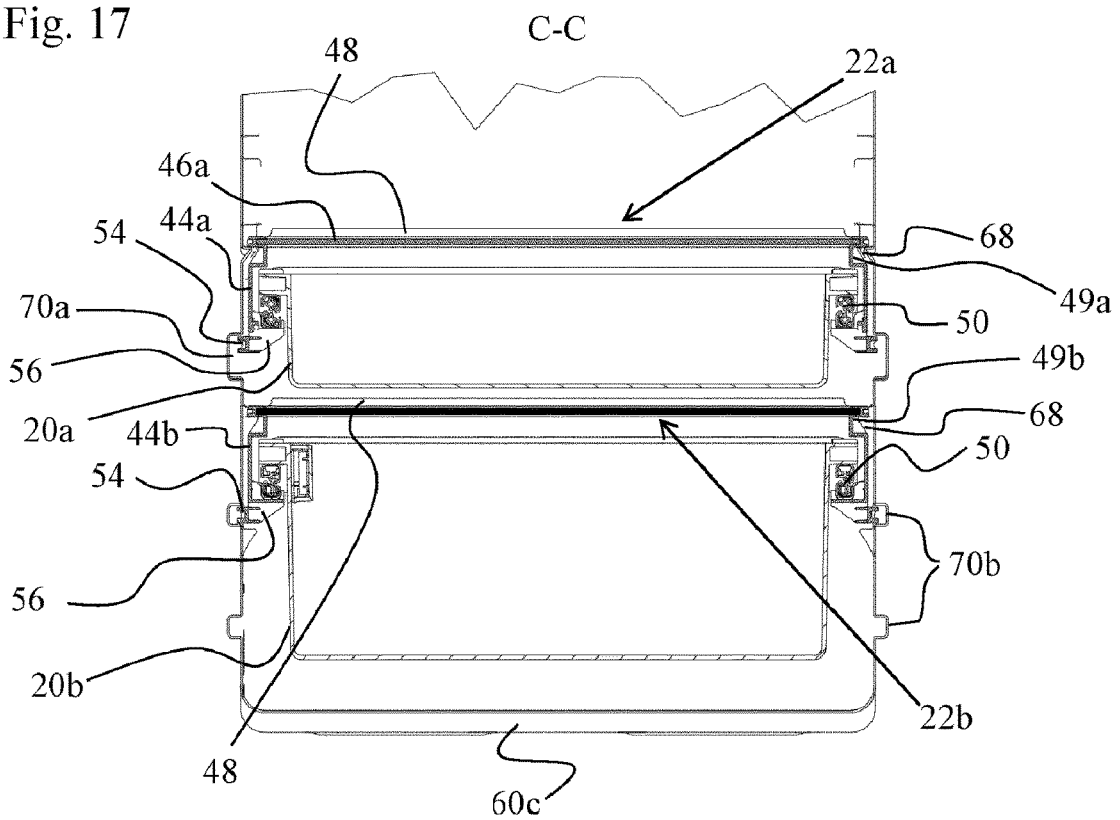
Figure 18A:
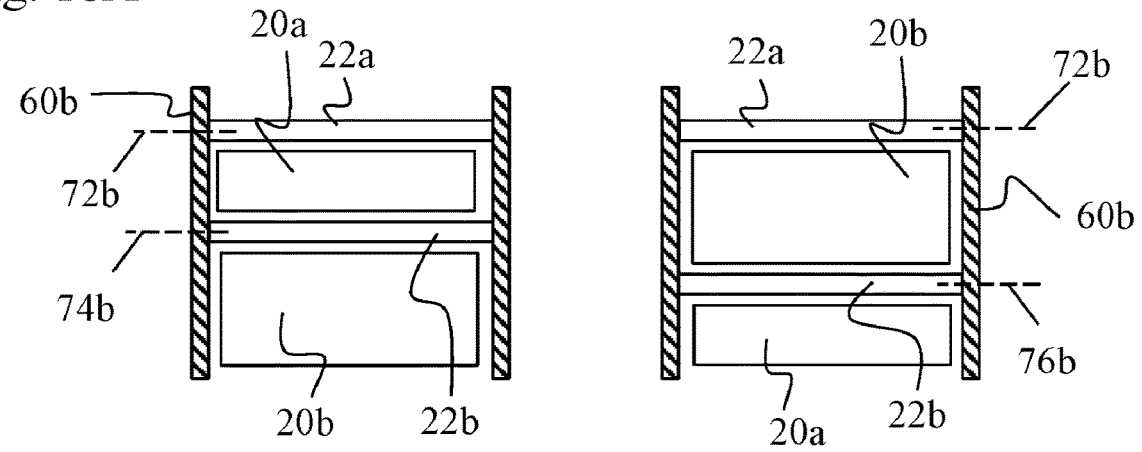
Figure 18B:
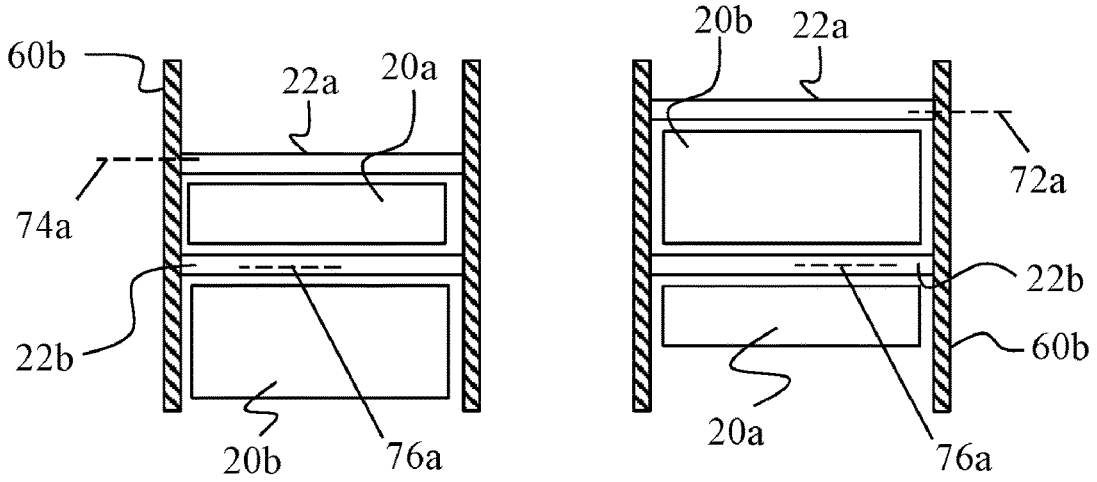
Figure 19:
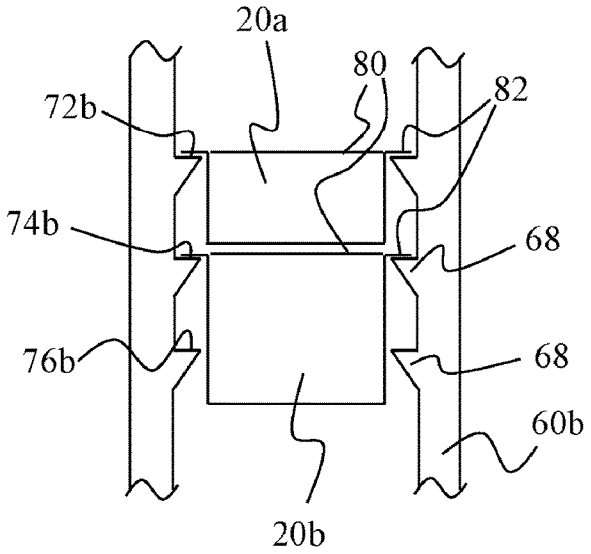
Figure 20:
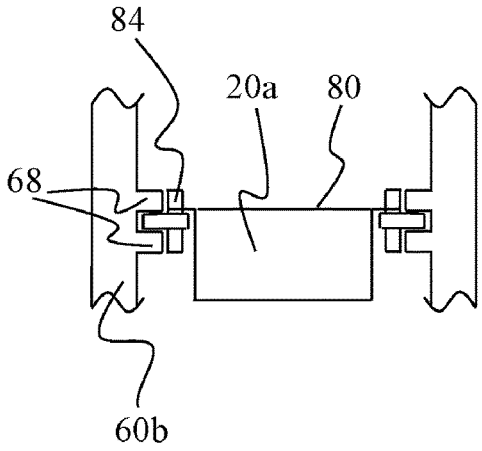
Figure 21A:
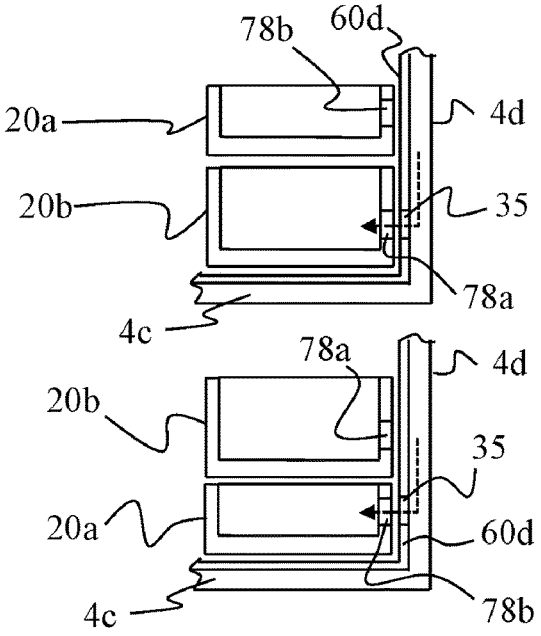
Figure 21B:
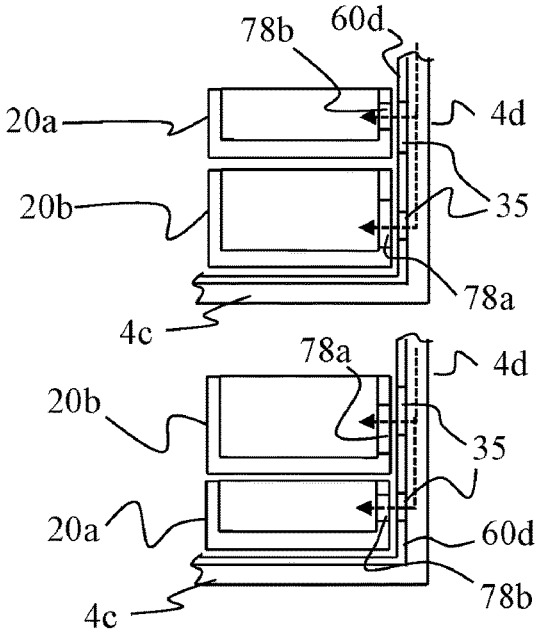

FIG. 16 a view of the inner side wall of the refrigerating compartment of FIG. 11A, FIG. 17 a sectional view of the refrigerating compartment according to the intersection line C-C of FIG. 16 with the first and second drawer, FIG. 18A a schematic front view of the refrigerating compartment with different vertical positions of the second shelf, FIG. 18B a schematic front view of the refrigerating compartment with different vertical positions of the first shelf, FIG. 19 a schematic front view of the refrigerating compartment with a second drawer exchange configuration, FIG. 20 a schematic front view of the refrigerating compartment with a third drawer exchange configuration, FIG. 21A a schematic sectional side view of the first and second drawer within the refrigerating compartment with another air inlet configuration and different positions of the drawers, and FIG. 21B a schematic sectional side view of the first and second drawer within the refrigerating compartment with another air inlet configuration and different positions of the drawers.

In the following main embodiments are described, a first embodiment represented by FIGS. 1 to 18B using drawers and shelves, a second embodiment represented by FIG. 19 using exchangeable drawers with bearing elements and a third embodiment represented by FIG. 20 using intermediate support elements for slidably supporting the exchangeable drawers in the refrigerating compartment. The following detailed description of the construction of the fridge-freezer (optionally also configured with a refrigerator) is applicable as an example for the refrigerating and/or freezing arrangement to be combined with all the embodiments.

FIG. 1 shows a perspective outer appearance of a fridge-freezer with an opened door and a first and a second drawer. The fridge-freezer 2 comprises a housing 4 having two side walls 4*a*, a rear wall 4*d*, a top wall 4*b* and a bottom wall 4*c*. At the inside of the housing 4, a refrigerating compartment 6 is arranged above a freezer compartment 10 separated from the refrigerating compartment 6. The front of the housing 4 may be provided with a door pivotably mounted to the housing 4, in particular to a front surface of one of the two side walls 4*a* and/or of the top wall 4*b* and/or the bottom wall 4*c*, by e.g. door hinges 26. Preferably, the fridge-freezer 2 is provided with one door 8 for the refrigerating compartment 6 and one door 12 for the freezer compartment 10. Alternatively, the fridge-freezer 2 only comprises one door for both compartments 6, 10. Each door may comprise a door seal 14*a*, 14*b* preferably running along the entire or substantially entire outer edge of the door 8, 12 for sealing the respective compartment 6, 10 when the doors 8, 12 are closed. Preferably the refrigerant compartment 6 is formed as an (inner) liner 60 inserted into the outer body of the fridge-freezer.

The freezer compartment 10 may comprise at least one chamber 16 for storing foodstuffs in a frozen state. As shown in FIG. 1, the freezer compartment 10 comprises three separate chambers 16 arranged in vertically different levels to each other. Preferably, each chamber is designed as a slidably supported drawer, as shown in FIG. 1. The drawer 16 may have a handle 24 arranged at the front wall, preferably at the top of the front wall of the drawer. Alternatively, each chamber may comprise a flap at the front for opening and closing the chamber 16.

The refrigerating compartment 6 may comprise at least one shelf 18 mounted within an upper region 6*a* of the compartment 6. As shown in FIG. 1, a plurality of shelves 18, in particular three shelves 18, are mounted horizontally within the compartment 6 at vertically different levels in the upper region 6*b*. In addition, or as an alternative, at least two shelves slidably supporting a drawer 20*a*, 20*b* may be mounted within a lower region 6*b* of the compartment 6. As shown in FIG. 1, a first (upper) shelf 22*a* slidably supporting a first drawer 20*a* and a second (lower) shelf 22*b* (see FIG. 8) slidably supporting a second drawer 20*b* are arranged in the lower region 6*b* at vertically different levels. As shown in FIG. 1, the first drawer 20*a* has a vertical extension being less than the vertical extension of the second drawer 20*b*. Thus, the first drawer 20*a* has a lower volume capacity than the second drawer 20*b*. The lower shelf 22*b* is arranged below the upper shelf 22*a*, in particular below the bottom of the first drawer 20*a* and the second drawer 20*b* is arranged immediately above the bottom of the refrigerating compartment 6. Thus, no further storage space between the bottom of the second drawer 20*b* and the bottom of the refrigerant compartment 6 is left.

Preferably, in the compartment space between the upper shelf 22*a* and the lower shelf 22*b* a first preservation condition, and in the compartment space below the lower shelf 22*b* a second preservation condition is provided. The first and second preservation conditions may be different to each other. The preservation conditions may comprise air humidity, air temperature and/or absorbing material absorbing components of the air affecting preservation of foodstuffs by using an absorbing material absorbing e.g. oxygen or carbon dioxide. The remaining space of the compartment, i.e. above the upper shelf 22*a*, may be provided with a preservation condition which is different to the first and/or second preservation condition. The different preservation conditions are established by introducing cold air through an air inlet at the bottom into the refrigerating compartment 6 which is described in detail with respect to FIGS. 3B, 4B, 13 and 15. Further alternatives of introducing the cold air are also described with respect to FIGS. 21A and 21B.

Alternatively, the upper and lower shelves 22*a*, 22*b* and the drawers 20*a*, 20*b* may be arranged at the middle or upper region 6*a*, in particular at the middle or top of the upper region 6*a*, of the compartment 6. Thus, further storage space (e.g. for further shelves 18 and/or drawers) above the upper shelf 22*a* and/or below the bottom of the second drawer is provided.

FIG. 2 shows the perspective outer appearance of the fridge-freezer of FIG. 1 with a reversed position of the first and second drawers 20*a*, 20*b*. The reversed position of the first and second drawers 20*a*, 20*b* and the second shelf (not shown) is the only difference with respect to FIG. 1. As shown in FIG. 2, the upper shelf 22*a* is at the same vertical position as in FIG. 1, but the vertical position of the lower shelf 22*b* is changed from a higher to a lower vertical position such that the second drawer 20*b* fits in the compartment space between the upper shelf 22*a* and the lower shelf 22*b*. The first drawer 20*a* is arranged below the lower shelf 22*b*. In particular, the positions of the first and second drawers 20*a*, 20*b* and thus their volume capacities are exchanged. Therefore, after exchange of the drawers, the first drawer previously provided with the first preservation condition is provided with the second preservation condition, and the second drawer previously provided with the second preservation condition is provided with the first preservation condition. Thus, the exchange of the drawers allows the user to adjust the capacities according to the needs of the user. The detailed designs of the shelves 22*a*, 22*b* and the compartment 6, which enable the exchange of the drawers 20*a*, 20*b* is described in more detail in the following figures.

FIG. 3A is a front view of the fridge-freezer of FIG. 2 and FIG. 3B is a sectional view of the fridge-freezer according to the intersection line B-B of FIG. 3A. The arrangement of the drawers 20*a*, 20*b* and the upper and lower shelf 22*a*, 22*b* corresponds to the arrangement of the fridge-freezer 2 of FIG. 1. The refrigerating compartment 6 may comprise a fan 28 for circulating the air of the compartment 6. The fan 28 may be arranged at the upper region 6*a* of the compartment, preferably within a rear wall of the compartment 6. More preferably, the fan 28 is arranged at the top or close to the top of the rear wall, in particular arranged in the middle when considering the vertical extension of the rear wall when seen the fridge-freezer from a front view (see FIG. 3A). Alternatively, the fan 28 may be arranged at a side wall or top wall of the compartment 6. A fan cover 28*a* may be arranged in front of the fan 28 for covering the fan 28. The fan cover 28*a* is preferably mounted at the rear wall of the compartment 6.

As shown in FIG. 3B, the air within the compartment 6 is sucked out of the compartment by the fan 28 through an air outlet 30 and is further flowing through an air duct 28 arranged between the rear wall of the refrigerating compartment 6 and the rear wall 4 *d* of the housing. The air duct 28 may extend from the top of the refrigerating compartment to the bottom of the refrigerating compartment 6. An evaporator 32 may be arranged within the air duct 28, preferably extending in a meandering shape from top to bottom of the air duct 28, for heat exchange between the air and another medium. The fridge-freezer shown in FIG. 3B comprises a refrigerating circuit in which a refrigerant is circulated between the evaporator 32, a compressor 34, an expansion device (not shown) and a condenser (not shown). As shown in FIG. 3B, the compressor 34 is arranged at the bottom of the freezer compartment 10 behind the drawers 16. The refrigerant is cooled in the condenser and the air flowing along the evaporator 32 is cooled by transferring heat from the air to the cold refrigerant. The cooled air is then reintroduced into the compartment 6 through an air inlet 35 preferably arranged at the bottom of the rear wall of the compartment. Alternatively, the air inlet 35 may be arranged at a side wall or at a bottom wall of the compartment. The air reintroduced through the air inlet 35 is then flowing from the bottom to the top of the compartment 6 and is then sucked again out of the compartment and is circulated again as described above. The air flow is also indicated in FIG. 3B by dashed arrows. The temperature of the cold air increases as it rises from bottom to top, which causes a temperature gradient. The different temperatures of the air at different vertical levels result in the first preservation condition in a volume section 21*a* of the first drawer 20 *a* and the second preservation condition in a volume section 21*b* the second drawer 20 *b* as mentioned above.

FIG. 4A shows a front view of the fridge-freezer of FIG. 1 and FIG. 4B shows a sectional view of the fridge-freezer according to the intersection line A-A of FIG. 4A. The arrangement of the drawers 20 *a*, 20 *b* and the upper and lower shelf 22 *a*, 22 *b* corresponds to the arrangement of the fridge-freezer 2 of FIG. 2. Thus, the only difference between the fridge-freezer of FIGS. 4A and 4B and FIGS. 3A and 3B is the reversed position of the first and second drawers 20 *a*, 20 *b* and the second shelf 22 *b*, wherein in particular the first shelf remains 20 *a* in its position and the second shelf 22 *b* is arranged in a vertical position being lower compared to its previous vertical position. By arranging the first drawer 20 *a* at the bottom of the compartment 6 below the bottom of the second drawer 20 *b*, the volume section 21*a* of the first drawer 20 *a* is provided with the second preservation condition and the volume section 21*b* of the second drawer 20 *b* arranged above the first drawer 20 *a* is provided with the first preservation condition. By arranging the second drawer 20 *b* (with higher vertical extension) in the lower or upper position, the user has the possibility to increase the capacity for storing foodstuffs in the first or second preservation condition.

FIG. 5 is an exploded view of the arrangement of the first shelf and the first drawer, FIG. 6 is a perspective view of the first shelf and the first drawer in an assembled state, and FIG. 7 is an exploded view of the first shelf.

The first shelf 22*a* is configured for being mounted horizontally within the compartment 6 and for slidably supporting the upper one of the first and second drawers 20*a*, 20*b*. The first shelf 22*a* may comprise an elongated recess 49*a*, 49*b* (see FIG. 17) on each side surface which is insertable into a pair of rail elements 68 provided at the inner side walls of the compartment 6 (see FIG. 11A). The shelf 22*a* may further comprise side walls 44*a* extending vertically at each elongated recess 49*a*, 49*b*. Each side wall 44*a* may be configured for slidably supporting a drawer by a drawer slide 50 mounted at each side wall 44*a*. In particular, the side wall 44*a* may comprise a horizontal mounting surface 56 at each lower end of the side wall 44*a* facing each other on which the drawer slides 50 are mountable. As shown in FIG. 6, the side walls 44*a* may also comprise locking elements 54 for locking the shelf in a horizontal position within the compartment 6. The locking elements 54 may be arranged at the lower end of the side wall 44*a*, preferably at the mid or substantially the mid of the lower end. The locking elements 54 may have any other position at the side walls of the first shelf 22*a*. The first shelf 20*a* can be released, for example, by pressing the locking elements 54 from the inside and can then be pulled out of the compartment 6. In a closed position of the drawer arranged below the first shelf 22*a*, the first shelf 22*a* may form the top of the drawer.

The top of the first shelf 22*a* may comprise a foodstuff stopper element 48 arranged at the rear of the first shelf 22*a* for preventing the foodstuff from touching the back wall of the compartment. The top of the first shelf 22*a* may further comprise a membrane element 46 which is preferably arranged at the front of the shelf. The membrane element 46 may extend along the entire or substantially entire width of the shelf 22*a*. The membrane element 46 is configured to adjust the amount of air circulating through the drawer arranged below the first shelf 22*a* and thus adjusts the humidity within the drawer. The membrane element 46 may comprise at least one membrane 46*a* (preferably only one membrane 46*a* as shown in FIG. 7), a membrane carrying element 46*c* (carrying grid) and a membrane cover 46*b*. In particular, the membrane 46*a* is arranged (sandwiched) between the membrane cover 46*b* and the carrying element 46*c*. Preferably, the membrane cover 46*b* is arranged above the membrane 46*a* and the carrying element 46*c* is arranged below the membrane 46. The carrying element 46*c* may be mounted at the front of the shelf. Preferably, the carrying element 46*c* is detachably or non-detachably mounted to the first shelf 22*a* by sliding into recesses provided on the first shelf 22*a*. When mounted, the membrane cover 46*b* preferably forms part of the top of the first shelf 22*a*.

The first drawer 20*a* comprises two side walls 36*a*, a bottom wall 38*a*, a front wall 42*a* and a rear wall 40*a*. Each side wall 36*a* of the first drawer 20*a* may be configured for mounting on the drawer slides 50 at the first (or second) shelf 22*a*. In particular, the drawer slides 50 may comprise at the back a hook-in element 50*a* and at the front a snap-in element 50*b*, wherein the top of the side walls 44*a* of the first drawer 20*a* may comprise at the rear a hook-in counter element 52*a* and at the front a snap-in counter element 52*b* for releasably mounting the drawer on the drawer slides 50.

FIG. 8 is an exploded view of the arrangement of the second shelf and the second drawer, FIG. 9 is a perspective view of the second shelf and the second drawer in an assembled state with a detailed view of the side wall of the second shelf, and FIG. 10 is a perspective view of the second shelf with a section.

The design of the second shelf 22*b* mainly corresponds to the design of the first shelf 22*a* described with respect to FIGS. 5 to 7. The second shelf 22*b* is configured for being mounted horizontally within the compartment 6 below the first shelf 22*a* and for slidably supporting the lower one of the first and second drawers 20*a*, 20*b*. The only difference to the first shelf 22*a* is the design of the top of the second shelf 22*b* and the design of the side wall 44*b*. The top of the second shelf 22*b* as shown in FIG. 5 is a flat surface forming the top of the drawer arranged below the second shelf 22*b* (top of first shelf 22*a* may comprise a membrane element). As shown in FIG. 9, the locking element 54 may be arranged at the lower end of the side wall 44*b*, preferably at the front of the lower end of the side wall 44*b*. However, the design of the first and second shelves, in particular of the top and of the side walls of the first and second shelves 22*a*, 22*b* may be different or may be equal.

The second shelf 22*b* may comprise a shelf cover element 49 mountable at the top of the shelf 22*b*. As shown in FIG. 10, the mounting surfaces 56 may comprise at least one fixing element 58 for fixing the drawer slides 50, preferably one fixing element at the front and one at the rear of the mounting surfaces 56. The features of the fixing element may also apply to the first shelf 22*a*.

The second drawer 20*b* comprises two side walls 36*b*, a bottom wall 38*b*, a front wall 42*b* and a rear wall 40*b*. Each side wall 36*b* of the second drawer 20*b* may be configured for mounting on the drawer slides 50 at the second (or first) shelf 22*b*. In a closed position of the drawer arranged below the second shelf 22*b*, the second shelf 22*b* may form the top of the drawer.

Each of the first and second drawers 20*a*, 20*b* may have an insulated material included in a wall preferably in the bottom wall. In addition or alternatively, the first and/or second shelf 22*a*, 22*b* may have an insulated material included in the horizontal portion (when considering the mounted state of the fridge-freezer).

FIG. 11A is a perspective view of the refrigerating compartment of the fridge-freezer without the shelves and the drawers and FIG. 11B is a detailed perspective view of region Z of FIG. 11A. The refrigerating compartment 6 comprises a top wall 60*a*, two side walls 60*b*, a bottom wall 60*c* and a rear wall 60*d*. Holding elements 66 for supporting shelves 18 as shown in FIG. 1 may be provided at the side walls 60*b* within the compartment 6. As shown in FIG. 11A, holding elements 66 are provided at the front of the side walls 60*b* and in addition snap-in elements 67 may be provided at the rear of the side walls 60*b* for locking the shelves 18 in its positions.

A pair of rail elements 68 may be provided at the side walls 60*b* of the compartment 6 for supporting the first and/or second shelves 22*a*, 22*b*. As shown in FIGS. 11A and 11B, three pairs of rail elements 68 are provided at three vertically different levels. The pairs of rail elements 68 are configured such that the first and/or second shelves 22*a*, 22*b* are insertable into the rail elements 68 with the elongated recesses 49*a*, 49*b*. Each side wall 60*b* of the compartment 6 may comprise a pair of recesses 70*a*, 70*b* configured for receiving the locking elements 54 of the first and/or second shelves 22*a*, 22*b* such that the shelves 22*a*, 22*b* are fixed in its positions after inserting into the respective pair of rail elements 68 within the compartment 6.

FIG. 12 is a perspective view of the refrigerating compartment of FIG. 11A with the first and second shelves and FIG. 13 is a front view of the refrigerating compartment of FIG. 12. The first shelf 22*a* is mounted at the uppermost pair of rail elements 68 and the second shelf 22*b* is mounted at the pair of rail elements 68 in the middle position. Thus, the first drawer 20*a* (the smaller drawer) is arrangeable between the first and second shelves 22*a*, 22*b* and the second drawer 20*b* (bigger drawer) is arrangeable below the second shelf 22*b*.

FIG. 14 is a perspective view of the refrigerating compartment of FIG. 12 with another positioning of the first and second shelves and FIG. 15 is a front view of the refrigerating compartment of FIG. 14. The first shelf 22*a* has the same position as the first shelf 22*a* in FIG. 12 (i.e. mounted at uppermost pair of rail elements 68) and the second shelf 22*b* is mounted at the pair of rail elements 68 in the lowest position. Thus, the second drawer 20*b* (bigger drawer) is arrangeable between the first and second shelves 22*a*, 22*b* and the first drawer 20*a* (the smaller drawer) is arrangeable below the second shelf 22*b*.

As shown in FIGS. 13 and 15, the air inlet 35 for introducing cold air into the refrigerating compartment 6 is arranged at the rear wall near the bottom of the compartment. In particular, the air inlet 35 is positioned such that the air is introduced below the second shelf 22*b* independent of whether the second shelf 22*b* is arranged in the middle or the lowest position (i.e. the air inlet 35 is arranged at and/or below the lowest pair of rail elements for receiving the shelves).

FIG. 16 is a view of the inner side wall of the refrigerating compartment of FIG. 11A and FIG. 17 is a sectional view of the refrigerating compartment according to the intersection line C-C of FIG. 16 with the first and second drawer. As can be seen in FIG. 17, the first shelf 22*a* supporting the first drawer 20*a* is mounted on the pair of rail elements 68 in the uppermost position, wherein the second shelf 22*b* supporting the second drawer 20*b* is mounted on the pair of rail elements 68 in the middle position. The locking elements 54 of the first shelf 22*a* are engaged with the recess 70*a* and the locking elements 54 of the second shelf 22*b* are engaged with the recess 70*b*. The drawer slides 50 for supporting the drawers 20*a*, 20*b* are arranged between the mounting surfaces 56 of each shelf 22*a*, 22*b* and the vertical extension at the side walls of each drawer.

In the following two different possibilities for exchanging the positions of the first and second drawer and the shelves are described.

FIG. 18A is a schematic front view of the refrigerating compartment with different vertical positions of the second shelf. As already described above and as shown in the previous Figures, the compartment 6 may comprise a first, a second and a third drawer support position 72*b*, 74*b*, 76*b*, wherein the second position 74*b* is vertically lower than the first position 72*b* and the third position 76*b* is vertically lower than the second position 74*b*. As shown on the left side in FIG. 18A, the first shelf 22*a* is arranged at the first vertical position 72*b* and the second shelf 22*b* is arranged at the second vertical position 74*b*, wherein the first drawer 20*a* is arranged below the first shelf 22*a* (provided with the first preservation condition) and the second drawer 20*b* is arranged below the second shelf 22*b* (provided with the second preservation condition). When exchanging the drawers 22*a*, 22*b*, the position of the first shelf 22*a* remains unchanged and the second shelf 22*b* is removed from the second vertical position 74*b* and is mounted at the third vertical position 76*b*. The result after the exchange of the drawers is shown on the right side of FIG. 18A. The second drawer 20*b* previously provided with the second preservation condition is now provided with the first preservation condition and the first drawer 20*a* previously provided with the first preservation condition is now provided with the second preservation condition.

FIG. 18B is a schematic front view of the refrigerating compartment with different vertical positions of the first shelf. FIG. 18B shows another possibility for exchanging the drawers different to FIG. 18A, in particular the position of the second shelf 22*b* remains unchanged and the exchange of the drawer is achieved by changing the position of the first shelf 22*a*.

The compartment 6 may comprises a first, a second and a third drawer support position 72*a*, 74*a*, 76*a*, wherein the second position 74*a* is vertically lower than the first position 72*b* and the third position 76*a* is vertically lower than the second position 74*a*. As shown on the left side in FIG. 18B, the first shelf 22*a* is arranged at the second vertical position 74*a* and the second shelf 22*b* is arranged at the third vertical position 76*a*, wherein the first drawer 20*a* is arranged below the first shelf 22*a* (provided with the first preservation condition) and the second drawer 20*b* is arranged below the second shelf 22*b* (provided with the second preservation condition). When exchanging the drawers 22*a*, 22*b*, the position of the second shelf 22*b* remains unchanged and the first shelf 22*a* is removed from the second vertical position 74*a* and is mounted at the first vertical position 72*a*. The result after the exchange of the drawers is shown on the right side of FIG. 18B. The second drawer 20*b* previously provided with the second preservation condition is now provided with the first preservation condition and the first drawer 20*a* previously provided with the first preservation condition is now provided with the second preservation condition.

With respect to FIGS. 18A and 18B, the air inlet 35 (not shown) is preferably provided at and/or below the second shelf 22*b* mounted at the third vertical positions 76*a*, 76*b*. Therefore, the first and second preservation conditions may be maintained independently of whether the first or second drawer is the lower one of the drawers.

In the embodiment described with respect to FIGS. 1 to 18, a fridge-freezer using drawers and shelves is described.

In the following two alternative embodiments are described, wherein each of these embodiments is applicable as an alternative to the embodiment using drawers and shelves. Accordingly, the following embodiments can be combined with all previously described features that do not refer to the shelves.

FIG. 19 is a schematic front view of the refrigerating compartment with a second drawer exchange configuration. The first and second drawer 20*a*, 20*b* each comprises a pair of bearing elements 82 arranged at each side wall of the drawer, preferably at the top of each side wall. The bearing elements 82 may be configured to slidably support the drawer at the first, second or third vertical position on a pair of rail elements 68 within the refrigerating compartment. In particular, the bearing elements 82 may be designed as vertical extensions facing the side walls 60*b* of the compartment. The bottom surface of the vertical extension and the surface of the rail elements may be directly movable on each other.

Each drawer may comprise a cover element 80 arranged at the top of the drawer. The cover element 80 may be designed as a pivotable cover or as a slidable cover. The slidable cover may either be designed in one piece so that the top of the drawer can be opened and closed by sliding the one part back and forth, or it may be designed as a two-part element so that the top of the drawer can be opened and closed by sliding the two parts against each other.

FIG. 20 is a schematic front view of the refrigerating compartment with a third drawer exchange configuration. The difference to the embodiment of FIG. 19 is that a pair of intermediate support elements 84, e.g. drawer slides, may be arranged between the drawers 20*a*, 20*b* and the rail elements 68. The intermediate support elements 84 may be fixed at the drawers 20*a*, 20*b* and are mounted releasably to the rail elements 68 such that, during exchange of the drawers, the drawer and the respective intermediate support elements 84 are exchanged. Alternatively, the intermediate support elements 84 are fixed at the rail elements 68 and the drawers 20*a*, 20*b* are releasably mounted to the intermediate support elements 84. The features described with respect to the cover element 80 of FIG. 19 are also applicable to the embodiment shown in FIG. 20.

FIG. 21A is a schematic sectional side view of the first and second drawer within the refrigerating compartment with another air inlet configuration and different positions of the drawers. The difference to the air inlet configuration shown in the previous Figures, in particular in FIGS. 12 to 15, is that each drawer 20*a*, 20*b* comprises at least one recess or opening 78*a*, 78*b* which is preferably arranged at the side and/or as shown in FIG. 21A at the rear wall of each drawer. The air inlet 35 at the rear wall of the compartment 60*d* and the recess 78*a*, 78*b* of each drawer may be configured such that the recess of the vertically positioned lower one of the first and second drawers 20*a*, 20*b* is alignable with the air inlet 35 such that the cold air introduced through the air inlet 35 is guidable through the recess into the drawer 20*a*. The alignment of the recess 78*a*, 78*b* and the air inlet 35 prevents the blocking of the air inlet 35 and ensures an air supply no matter if the first or second drawer 20*a*, 20*b* is arranged in the lower vertical position. After inserting the vertically positioned lower drawer of the first and second drawers 20*a*, 20*b*, the drawer and the air inlet 35 may be e.g. so close that the air can flow through the air inlet 35 in form of a free air flow directly into the drawer, or alternatively, the air inlet 35 may be provided with an elastic seal (e.g. gasket, not shown) forming an air channel between the air inlet 35 and the recess of the drawer after insertion of the drawer. Thereby, the inside of the vertically positioned lower drawer of the first and second drawers 20*a*, 20*b* is supplied or fed with cold air through the recess 78*a*, 78*b*, wherein the vertically positioned upper drawer of the first and second drawers is cooled by the air flowing around the drawer.

Preferably, the drawers comprise slits or other small openings with a different shape arranged within the drawers, in particular at a side wall or a front wall of each drawer through which the air can exit each drawer.

FIG. 21B is a schematic sectional side view of the first and second drawer within the refrigerating compartment with another air inlet configuration and different positions of the drawers. In contrast to the air inlet configuration of FIG. 21A, the refrigerating compartment 6 may comprise at least one air inlet 35 for the upper and at least one air inlet 35 for the lower one of the first and second drawers 20*a*, 20*b*. The air inlets 35 are preferably arranged at the rear wall 60*d* of the refrigerating compartment. In particular, the air inlets 35 are positioned such that they are alignable with the recesses 78*a*, 78*b* of the first and second drawers 20*a*, 20*b* independently whether the first or second drawer is arranged in the upper or lower position. Thereby, the inside of both drawers 20*a*, 20*b* is supplied or fed directly with cold air through the recesses 78*a*, 78*b*. As already described with respect to the embodiment of FIG. 21A, after inserting the first and/or second drawer, the drawer and the respective air inlet 35 may be e.g. so close that the air can flow through the air inlet 35 in form of a free air flow directly into the drawer, or alternatively, the air inlet 35 may be provided with an elastic seal (e.g. gasket, not shown) forming an air channel between the air inlet 35 and the recess of the drawer after insertion of the drawer.

REFERENCE NUMERAL LIST

2 fridge-freezer
4 housing
4*a* side wall
4*b* top wall
4*c* bottom wall
4*d* rear wall
6 refrigerating compartment
6*a* upper region
6*b* lower region
8 door of refrigerating compartment
10 freezer compartment
12 door of freezer compartment
14*a*, 14*b* door seal
16 chamber (drawer) of freezer compartment
18 shelf
20*a*, 20*b* first/second drawer of refrigerating compartment
22*a*, 22*b* first (upper)/second (lower) shelf
24 handle
26 door hinge
28 fan
28*a* fan cover
30 air outlet
31 air duct
32 evaporator
34 compressor
35 air inlet into refrigerating compartment
36*a*, 36*b* drawer side wall
38*a*, 38*b* drawer bottom
40*a*, 40*b* drawer rear wall
42*a*, 42*b* drawer front wall
44*a*, 44*b* side (mounting) wall
46 membrane element

46*a* membrane
46*b* membrane cover
46*c* membrane carrying element
48 foodstuff stopper element
49 shelf cover element
49*a*, 49*b* elongated recess
50 drawer slide
50*a* hook-in element of drawer slide
50*b* snap-in element of drawer slide
52*a* hook-in counter element of drawer
52*b* snap-in counter element of drawer
54 locking element of shelf
56 mounting surface for drawer slide
58 fixing element for fixing drawer slide to shelf
60 inner liner of refrigerating compartment
60*a* top wall of refrigerating compartment
60*b* side wall of refrigerating compartment
60*c* bottom wall of refrigerating compartment
60*d* rear wall of refrigerating compartment
66 holding element for shelf
67 snap-in element for shelf
68 rail element
70*a*, 70*b* recess for locking element of first/second shelf
72*a*, 72*b* first drawer support position (first vertical position) of first/second shelf
74*a*, 74*b* second drawer support position (second vertical position) of first/second shelf
76*a*, 76*b* third drawer support position (third vertical position) of first/second shelf
78*a*, 78*b* recess for guiding air into drawer
80 cover element
82 bearing element
84 intermediate support element

The invention claimed is:

1. A refrigeration appliance, in particular a refrigerator or a fridge-freezer (2), comprising:

a housing (4), a refrigerating compartment (6) formed within the housing (4), a first drawer (20*a*) extending vertically a first distance, a second drawer (20*b*) extending vertically a second distance that is greater than the first distance, and a first drawer support position (72*a*, 72*b*), a second drawer support position (74*a*, 74*b*), and a third drawer support position (76*a*, 76*b*) configured for slidably and releasably supporting the first drawer (20*a*) and second drawer (20*b*), wherein in the vertical direction the first drawer support position (72*a*, 72*b*) is higher than the second drawer support position (74*a*, 74*b*) and the second drawer support position (74*a*, 74*b*) is higher than the third drawer support position (76*a*, 76*b*), wherein the first and second drawers (20*a*, 20*b*) are configured such that:

A) a lower level of the first drawer (20*a*) will be at a first vertical position within the refrigerating compartment (6) when the first drawer (20*a*) is supported at the third drawer support position (76*a*, 76*b*), and a lower level of the second drawer (20*b*) will be at the same first vertical position within the refrigerating compartment (6) when the second drawer (20*b*) is supported at the second drawer support position (74*a*, 74*b*), or B) the lower level of the first drawer (20*a*) will be at a second vertical position within the refrigerating compartment (6) when the first drawer (20*a*) is supported at the second drawer support position (74*a*, 74*b*), and the lower level of the second drawer (20*b*) will be at the same second vertical position within the refrigerating compartment (6) when the second drawer (20*b*) is supported at the first drawer support position (72*a*, 72*b*).

2. The refrigeration appliance according to claim 1, wherein in option B) a height difference between the first drawer support position (72*a*, 72*b*) and the second drawer support position (74*a*, 74*b*) corresponds or substantially corresponds to a difference between the first distance of the first drawer (20*a*) and the second distance of the second drawer (20*b*).

3. The refrigeration appliance according to claim 1, wherein the first drawer (20*a*) has a pair of bearing elements (82) adapted to slidably and releasably support the first drawer (20*a*) at a pair of rail elements (68) formed at side walls of the refrigerating compartment (60*b*).

4. The refrigeration appliance according to claim 1, wherein the refrigerating compartment (6) has a plurality of pairs of rail elements (68) provided at opposing lateral sides of the refrigerating compartment (6), wherein the plurality of pairs of rail elements (68) comprises:

a first pair of rail elements (68) provided at the vertical height of the first drawer support position (72*a*, 72*b*), a second pair of rail elements (68) provided at the vertical height of the second drawer support position (74*a*, 74*b*), and a third pair of rail elements (68) provided at the vertical height of the third drawer support position (76*a*, 76*b*).

5. The refrigeration appliance according to claim 3, wherein a pair of intermediate support elements (84) for slidably supporting the first drawer (20*a*) is provided at opposing lateral sides of the first drawer (20*a*) between the pair of bearing elements (82) and the pair of rail elements (68).

6. The refrigeration appliance according to claim 1, further comprising an upper shelf (22*a*) mounted within the compartment (6), and a lower shelf (22*b*) mounted within the compartment (6) at a vertical position below the upper shelf (22*a*), wherein:

A) the upper shelf (22*a*) is mounted in the compartment (6) at the first drawer support position (72*a*, 72*b*) and the lower shelf (22*b*) is releasably mounted in the compartment (6) at the second drawer support position (74*a*, 74*b*) or the third drawer support position (76*a*, 76*b*), or B) the upper shelf (22*a*) is releasably mounted in the compartment (6) at the first drawer support position (72*a*, 72*b*) or the second drawer support position (74*a*, 74*b*), and the lower shelf (22*b*) is mounted in the compartment (6) at the third drawer support position (76*a*, 76*b*), wherein the first drawer (20*a*) is adapted to be slidably supported below the upper shelf (22*a*) or below the lower shelf (22*b*), and the second drawer (20*b*) is adapted to be slidably supported below the upper shelf (22*a*) or below the lower shelf (22*b*), wherein the first drawer (20*a*) fits between the upper and lower shelves (22*a*, 22*b*) when A) the lower shelf (22*b*) is mounted in the second drawer support position (74*a*, 74*b*), or B) the upper shelf (22*a*) is mounted in the second drawer support position (74*a*, 74*b*), and wherein the second drawer (20*b*) fits between the upper and lower shelves (22*a*, 22*b*) when A) the lower shelf (22*b*) is mounted in the third drawer support position (76*a*, 76*b*), or B) the upper shelf (22*a*) is mounted in the first drawer support position (72*a*, 72*b*).

7. The refrigeration appliance according to claim 1, wherein in operation of the refrigeration appliance:

i) a first preservation condition is provided in an upper volume section, wherein the upper volume section is within the vertically positioned upper one of the first and second drawers (20*a*, 20*b*) and/or between the upper level of the vertically positioned upper one of the first and second drawers (20*a*, 20*b*) and the upper level of the vertically positioned lower one of the first and second drawers (20*a*, 20*b*), and ii) a second preservation condition is provided in a lower volume section, wherein the lower volume section is within the vertically positioned lower one of the first and second drawers (20*a*, 20*b*) and/or below the upper level of the vertically positioned lower one of the first and second drawers (20*a*, 20*b*), and wherein the first and second preservation conditions are different to each other.

8. The refrigeration appliance according to claim 7, wherein the first and/or second preservation condition comprises one or more comprises one or more preservation conditions from a group consisting of:

an air temperature, an air humidity, and absorbing components of the air affecting the preservation of foodstuffs by using an absorbing material.

9. The refrigeration appliance according to claim 7, wherein the temperature within the upper volume section is in the range of 2-4, 3-5 or 4-6° C. and/or the temperature within the lower volume section is in the range of −3 to −1, −2 to 1, −1 to 2, 0 to 3 or 1 to 4° C.

10. The refrigeration appliance according to claim 7, wherein in operation of the appliance the air humidity within the first and/or second drawer (20*a*, 20*b*) is established by at least one membrane mounted at the top of the first and/or second drawer (20*a*, 20*b*).

11. The refrigeration appliance according to claim 8, wherein the absorbing material is adapted to absorb odors and/or ethylene, in particular the absorbing material is a solid material such as oxygen and/or carbon dioxide absorbers.

12. The refrigeration appliance according to claim 8, wherein the absorbing material is arranged within the first and/or second drawer (20*a*, 20*b*), wherein the absorbing material is arranged at least at one cover element or at the upper and/or lower shelf, and/or at an inner wall of the refrigerating compartment (6) surrounding the lower volume section and/or the upper volume section.

13. The refrigeration appliance according to claim 7, wherein in operation of the appliance, the difference in preservation conditions between the upper and lower volume section is established by cold air flowing towards the first and/or second drawer (20*a*, 20*b*), and/or towards the compartment space below the upper level of the vertically positioned lower one of the first and second drawers (20*a*, 20*b*) and/or towards the compartment space below the upper level of the vertically positioned upper one of the first and second drawers (20*a*, 20*b*).

14. The refrigeration appliance according to claim 7, wherein in operation of the appliance, cold air is introduced into the refrigerating compartment (6) through at least one air inlet (35) arranged at an inner wall of the refrigerating compartment (6) below the upper level of the vertically positioned lower one of the first and second drawers (20*a*, 20*b*), and wherein the difference between the first and second preservation conditions is established by:

cold air introduced through the air inlet (35) and flowing around the first and second drawers (20*a*, 20*b*), or cold air introduced through the air inlet (35) and flowing into the vertically positioned lower and/or upper one of the first and second drawers (20*a*, 20*b*), wherein each drawer (20*a*, 20*b*) comprises at least one recess (78*a*, 78*b*) arranged at a side wall (36*a*, 36*b*) and/or a rear wall (40*a*, 40*b*) of the drawer (20*a*, 20*b*), and wherein the air inlet (35) and the at least one recess (78*a*, 78*b*) of each drawer (78*a*, 78*b*) are configured such that the cold air introduced through the air inlet (35) is guidable through the at least one recess (78*a*, 78*b*) of the vertically positioned lower one of the first and second drawers (20*a*, 20*b*) into the drawer (20*a*, 20*b*).

15. A method for exchanging first and second drawers (20*a*, 20*b*) in the refrigeration appliance according to claim 1, wherein the method comprises:

a removing step that comprises:

A) removing the first drawer (20*a*) or second drawer (20*b*) from the first drawer support position (72*a*, 72*b*), and removing either the second drawer (20*b*) from the second drawer support position (74*a*, 74*b*) or the first drawer (20*a*) from the third drawer support position (76*a*, 76*b*), or B) removing the first drawer (20*a*) or second drawer (20*b*) from the third drawer support position (76*a*, 76*b*), and removing either the second drawer (20*b*) from the first drawer support position (72*a*, 72*b*) or the first drawer (20*a*) from the second drawer support position (74*a*, 74*b*); and a mounting step that comprises:

A) mounting the first drawer (20*a*) at the third drawer support position (76*a*, 76*b*) and the second drawer (20*b*) at the first drawer support position (72*a*, 72*b*), or mounting the first drawer (20*a*) at the first drawer support position (72*a*, 72*b*) and the second drawer (20*b*) at the second drawer support position (74*a*, 74*b*), or B) mounting the first drawer (20*a*) at the second drawer support position (74*a*, 74*b*) and the second drawer (20*b*) at the third drawer support position (76*a*, 76*b*), or mounting the second drawer (20*b*) at the first drawer support position (72*a*, 72*b*) and the first drawer (20*a*) at the third drawer support position (76*a*, 76*b*).

16. The refrigeration appliance according to claim 1, wherein:

A) an upper level of the first drawer (20*a*) will be at a third vertical position within the refrigerating compartment (6) when the first drawer (20*a*) is supported at the at the first drawer support position (72*a*, 72*b*), and an upper level of the second drawer (20*b*) will be at the same third vertical position within the refrigerating compartment (6) when the second drawer (20*b*) is supported at the first drawer support position (72*a*, 72*b*), or B) the upper level of the first drawer (20*a*) will be at a fourth vertical position within the refrigerating compartment (6) when the first drawer (20*a*) is supported at the at the third drawer support position (76*a*, 76*b*), and the upper level of the second drawer (20*b*) will be at the same fourth vertical position within the refrigerating compartment (6) when the second drawer (20*b*) is supported at the third drawer support position (76*a*, 76*b*).

17. A method for mounting the first and second drawers (20*a*, 20*b*) in the refrigeration appliance according to claim 1, wherein the method comprises:

A) mounting the first drawer (20*a*) at the third drawer support position (76*a*, 76*b*) such that the lower level of the first drawer (20*a*) is at the first vertical position, and mounting the second drawer (20*b*) at the second drawer support position (74*a*, 74*b*) such that the lower level of the second drawer (20*b*) is at the same first vertical position, or B) mounting the first drawer (20*a*) at the second drawer support position (74*a*, 74*b*) such that the lower level of the first drawer (20*a*) is at the second vertical position, and mounting the second drawer (20*b*) at the first drawer support position (72*a*, 72*b*) such that the lower level of the second drawer (20*b*) is at the same second vertical position.

* * * * *